US010211509B2

(12) United States Patent
Kagaya

(10) Patent No.: US 10,211,509 B2
(45) Date of Patent: Feb. 19, 2019

(54) VEHICLE WINDOW GLASS AND ANTENNA

(71) Applicant: AGC INC., Tokyo (JP)

(72) Inventor: Osamu Kagaya, Tokyo (JP)

(73) Assignee: AGC INC., Tokyo (JP)

( * ) Notice: Subject to any disclaimer, the term of this patent is extended or adjusted under 35 U.S.C. 154(b) by 0 days.

(21) Appl. No.: 15/817,151

(22) Filed: Nov. 17, 2017

(65) Prior Publication Data

US 2018/0090811 A1 Mar. 29, 2018

Related U.S. Application Data

(63) Continuation of application No. PCT/JP2016/063402, filed on Apr. 28, 2016.

(30) Foreign Application Priority Data

May 21, 2015 (JP) ..... 2015-103675
Apr. 20, 2016 (JP) ..... 2016-084756

(51) Int. Cl.
*H01Q 1/32* (2006.01)
*H01Q 1/12* (2006.01)
(Continued)

(52) U.S. Cl.
CPC ..... *H01Q 1/1271* (2013.01); *H01Q 1/1278* (2013.01); *H01Q 1/325* (2013.01);
(Continued)

(58) Field of Classification Search
CPC .... H01Q 1/3266; H01Q 1/3275; H01Q 1/282; H01Q 1/325; H01Q 21/28; H01Q 9/22; H01Q 1/2266
(Continued)

(56) References Cited

U.S. PATENT DOCUMENTS 5,719,585 A * 2/1998 Tabata ..... H01Q 1/1271 343/704
2011/0279335 A1 11/2011 Degen et al.
(Continued)

FOREIGN PATENT DOCUMENTS

JP 61-121010 U1 7/1986
JP 62-193304 A 8/1987
(Continued)

OTHER PUBLICATIONS

International Search Report and Written Opinion received in International Application No. PCT/JP2016/063402 dated Jun. 28, 2016 with English-language translation of ISR.

*Primary Examiner* — Joseph J Lauture
(74) *Attorney, Agent, or Firm* — Foley & Lardner LLP

(57) ABSTRACT

A vehicle window glass includes a glass plate; a dielectric body; a conductive body arranged between the glass plate and the dielectric body; and an antenna. The conductive body includes a concave portion is provided. The concave portion is interposed between a first vertical edge side and a second vertical edge side extending downward from an upper outer edge of the conductive body. The antenna includes a feeding portion and an antenna element. A part of the feeding portion and a part of the antenna element are located in a region of at least one of a region interposed between a first extension line and a second extension line extended upward from the first vertical edge side and the second vertical edge side, and of the concave portion. The feeding portion is arranged closer to the first vertical edge side than a lower end of the concave portion.

20 Claims, 21 Drawing Sheets

(51) Int. Cl.

| | |
|---|---|
| ***H01Q 9/30*** | (2006.01) |
| ***H01Q 13/10*** | (2006.01) |
| *H01Q 1/28* | (2006.01) |
| *H01Q 21/28* | (2006.01) |
| *H01Q 9/22* | (2006.01) |
| *H01Q 1/22* | (2006.01) |
| *H01Q 1/40* | (2006.01) |

(52) U.S. Cl.
CPC ..... *H01Q 9/30* (2013.01); *H01Q 13/10* (2013.01); *H01Q 1/2266* (2013.01); *H01Q 1/282* (2013.01); *H01Q 1/32* (2013.01); *H01Q 1/3266* (2013.01); *H01Q 1/3275* (2013.01); *H01Q 1/40* (2013.01); *H01Q 9/22* (2013.01); *H01Q 21/28* (2013.01)

(58) Field of Classification Search
USPC ..... 343/713, 711, 726, 728, 900, 906
See application file for complete search history.

(56) References Cited

U.S. PATENT DOCUMENTS

| | | | |
|---|---|---|---|
| 2015/0357700 | A1 | 12/2015 | Kagaya et al. |
| 2016/0006112 | A1 | 1/2016 | Kagaya et al. |
| 2016/0118708 | A1 | 4/2016 | Suenaga et al. |
| 2016/0134013 | A1 | 5/2016 | Suenaga et al. |

FOREIGN PATENT DOCUMENTS

| | | | |
|---|---|---|---|
| JP | 2001-127520 | A | 5/2001 |
| WO | WO-2012/079040 | A1 | 6/2012 |
| WO | WO-2014/129588 | A1 | 8/2014 |
| WO | WO-2014-157535 | A1 | 10/2014 |
| WO | WO-2015-016067 | A1 | 2/2015 |
| WO | WO-2015-019904 | A1 | 2/2015 |

* cited by examiner

| ANTENNA SHAPE | 3A | 3B | 3C |
|---|---|---|---|
| |   |   |   |
| ASPECT RATIO | 0.28 | 1.73 | 18.14 |
| BAND III | −6.0 dBd | −6.0 dBd | −6.7 dBd |
| L BAND | −9.7 dBd | −9.8 dBd | −7.8 dBd |

VEHICLE WINDOW GLASS AND ANTENNA

CROSS-REFERENCE TO RELATED APPLICATION

The present application is a continuation application filed under 35 U.S.C. 111(a) claiming benefit under 35 U.S.C. 120 and 365(c) of PCT International Application No. PCT/JP2016/063402 filed on Apr. 28, 2016 and designating the U.S., which claims priority of Japanese Patent Applications No. 2015-103675 filed on May 21, 2015 and No. 2016-084756 filed on Apr. 20, 2016. The entire contents of the foregoing applications are incorporated herein by reference.

BACKGROUND OF THE INVENTION

1. Field of the Invention

The disclosure herein generally relates to a vehicle window glass and an antenna.

2. Description of the Related Art

A technology, in a vehicle window glass having a conductive thin film, of arranging a feeding portion of an antenna pattern in a film omission region of the conductive thin film has been known (For example, see Japanese Unexamined Patent Application Publication No. 2001-127520).

SUMMARY OF THE INVENTION

Technical Problem

In a concave portion such as the above-described film omission region, electrical equipment product such as a rain sensor or a camera is often attached. However, when the feeding portion of the antenna is located at a central portion of the concave portion or in a lower part, a wiring member such as a coaxial cable to be connected to the feeding portion is liable to get in the way of attaching the electrical equipment product to the concave portion, as in the related art.

The present invention aims at providing a vehicle window glass and an antenna, in which a wiring member such as a coaxial cable can be connected to a feeding portion so that the wiring member does not get in the way of attaching an electrical equipment product to a concave portion.

Solution to Problem

According to an aspect of the present invention, a vehicle window glass, provided with a glass plate; a dielectric body; a conductive body arranged between the glass plate and the dielectric body; and an antenna, the conductive body including an upper edge portion in which a concave portion is provided, the concave portion being a region interposed between a first vertical edge side and a second vertical edge side extending downward from an upper outer edge of the conductive body, the antenna including a feeding portion, and an antenna element electrically connected to the feeding portion, in a planar view of the vehicle window glass, at least a part of the feeding portion and at least a part of the antenna element being located in a region of at least one of a region interposed between a first extension reference line extended upward from the first vertical edge side and a second extension reference line extended upward from the second vertical edge side and of the concave portion, and in a planar view of the vehicle window glass, the feeding portion being arranged at a position closer to the first vertical edge side than a lower end of the concave portion, is provided.

Effect of Invention

According to an aspect of the present invention, the feeding portion is arranged at a position closer to an upper end of the first vertical edge side than the lower end of the concave portion, and is located adjacent to the upper end of the first vertical edge side. Then, it becomes possible to connect a wiring member to the feeding portion so that the wiring member, such as a coaxial cable, does not get in the way of attaching an electrical equipment product to the concave portion.

DETAILED DESCRIPTION OF THE PREFERRED EMBODIMENTS

Figure 1:
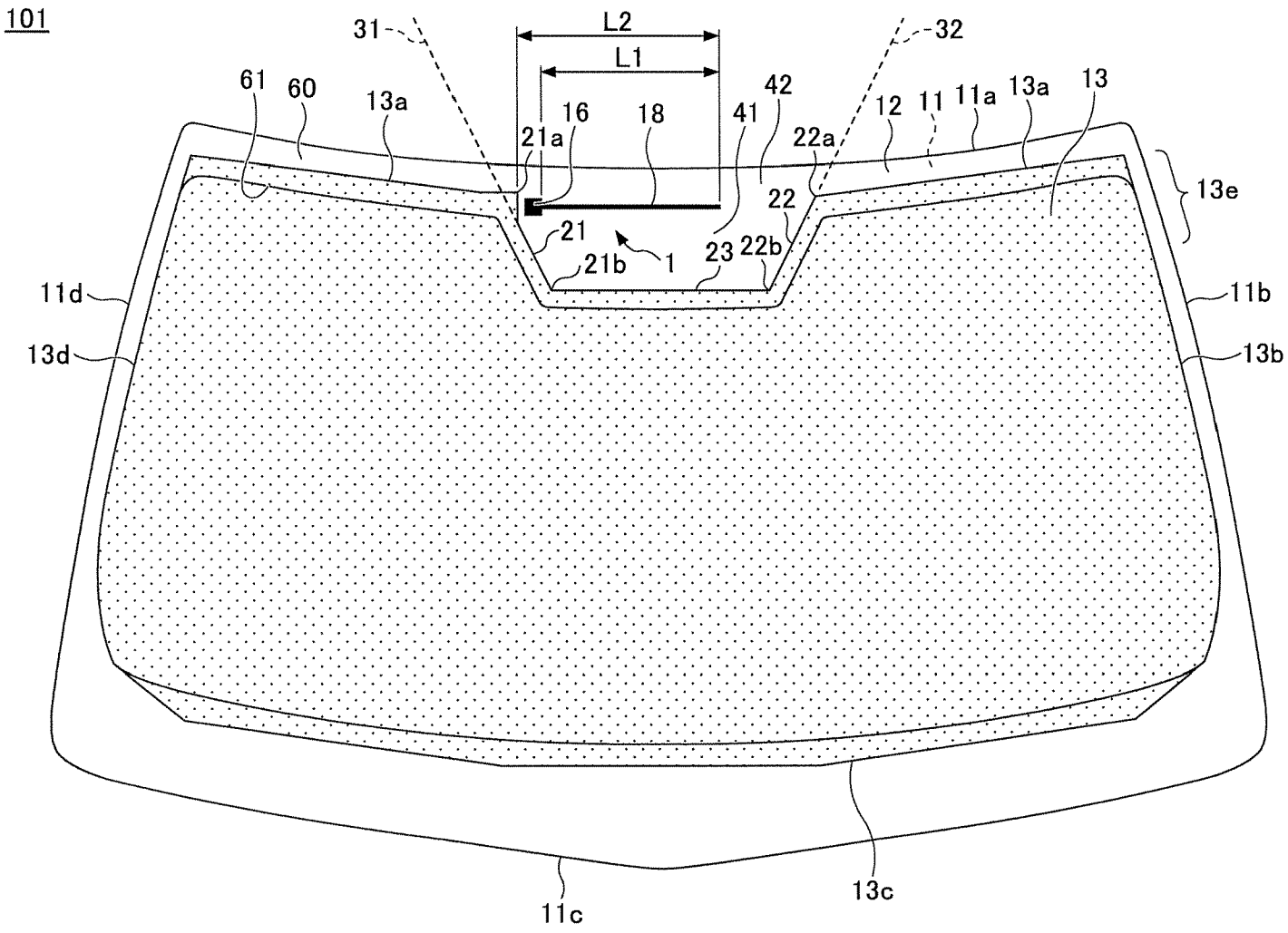
FIG. 1 is a plan view depicting an example of a configuration of a vehicle window glass.

In the following, with reference to drawings, embodiments for implementing the present invention will be described. In the drawings for describing embodiments, in the absence of a specific description with respect to a direction, the direction refers to a direction on the drawings. Reference directions in the respective drawings correspond to directions of symbols or numerals. Moreover, a direction, such as parallel, or orthogonal, or the like allows a deviation enough to keep the effect of the present invention. Moreover, a window glass, to which the present invention can be applied, includes for example a front windshield mounted at a front part of a vehicle. Note that the window glass may be a rear windshield mounted at a rear part of the vehicle, a side glass mounted at a side part of the vehicle, a roof glass mounted at a ceiling part of the vehicle, or the like.

FIG. 1 is a plan view illustrating a window glass 101 according to an embodiment in a planar view. The window glass 101 is an example of a vehicle window glass including a first glass plate 11, a second glass plate 12, a conductive body 13 and an antenna 1. FIG. 1 shows a state in which the first glass plate 11 and the second glass plate 12 overlay each other, and shows a state in which the conductive body 13 is viewed through the second glass plate 12.

The first glass plate 11 and the second glass plate 12 are transparent or translucent plate-like dielectric bodies. The window glass 101 is a laminated glass in which the first glass plate 11 arranged on a vehicle exterior side and the second glass plate 12 arranged on a vehicle interior side may be bonded via an intermediate film.

In addition, the vehicle window glass according to the embodiment is not limited to a laminated glass in which a plurality of glass plates are bonded. The vehicle window glass may be provided with a glass plate, a plate-like dielectric body, and a conductive body arranged between the glass plate and the plate-like dielectric body.

The conductive body 13 is an example of a conductive body arranged so as to extend flat between the first glass plate 11 and the second glass plate 12. The conductive body 13 illustrated in FIG. 1 is, for example, a conductive film that reflects solar light coming from outside the vehicle and insulates for heat. The conductive film is a transparent or translucent conductive film.

The conductive body 13 is, for example, arranged by stacking on a vehicle interior surface of the first glass plate 11 or a vehicle exterior surface of the second glass plate 12. When the window glass 101 is a laminated glass, the conductive body 13 may be arranged between the first glass plate 11 and the second glass plate 12 that configure the laminated glass, or may be arranged to be interposed between an intermediate film and one of the glass plates.

The conductive body 13 may be famed by coating a conductive material (e.g. silver) on a surface of a glass plate through a vapor deposition process by using a sputtering method or the like. Alternatively, the conductive body 13 may be formed by coating on a resin film (e.g. polyethylene terephthalate) that is a different member from the glass plate through a vapor deposition process. Moreover, for the conductive material, for example, a zinc oxide-based film (e.g. zinc oxide film including gallium (GZO film)), ITO (compound oxide of indium and tin), gold, copper, or the like may be used.

At least a part of an outer edge of the conductive body 13 is offset with respect to glass edges 11*a* to 11*d* that are outer edges of the first glass plate 11. The part of the outer edge of the conductive body 13 may coincide with the glass edges 11*a* to 11*d*. The conductive body 13 includes an upper outer edge 13*a*, a right outer edge 13*b*, a lower outer edge 13*c*, and a left outer edge 13*d*. Note that a shape of the conductive body 13 is not limited to the form illustrated in the drawings.

The conductive body 13 includes an upper edge portion 13*e* in which a concave portion 41 recessed with respect to the upper outer edge 13*a* is arranged. The concave portion 41 is a region interposed between a first vertical edge side 21 and a second vertical edge side 22 in the horizontal direction. The first vertical edge side 21 and the second vertical edge side 22 are edges extending downward from the upper outer edge 13*a* of the conductive body 13, and are parts of the outer edge of the conductive body 13. The first vertical edge side 21 extends from an upper left end 21*a* of the upper outer edge 13*a* on the left to a lower left end 21*b*. The second vertical edge side 22 extends from an upper right end 22*a* of the upper outer edge 13*a* on the right to a lower right end 22*b*. A horizontal edge side 23 is an edge connecting the lower left end 21*b* and the lower right end 22*b*, and is a part of the outer edge of the conductive body 13. The horizontal edge side 23 is also a lower end of the concave portion 41.

Figure 13:
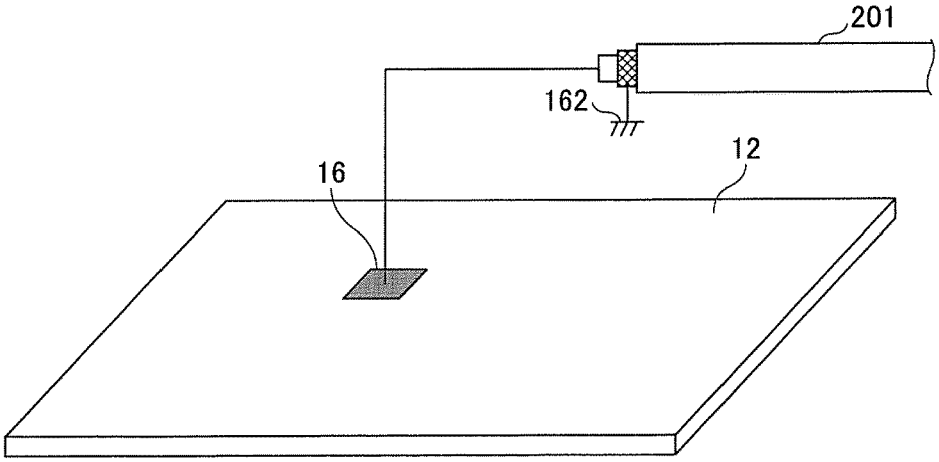
FIG. 13 is a diagram depicting an example of a connection of a coaxial cable.

The antenna 1 includes a first feeding portion 16 and an antenna element 18 electrically connected to the first feeding portion 16, and is fed via the first feeding portion 16. The antenna 1 is, for example, a monopole antenna of a unipolar type that is provided with the first feeding portion 16 as one electrode. In the case of the antenna 1, for example, as illustrated in FIG. 13, an inner conductive body of a coaxial cable 201 connected to a signal processing device including a reception circuit is electrically connected to the first feeding portion 16. An outer conductive body of the coaxial cable 201 is electrically connected to a vehicle body (ground 162).

In a planar view of the window glass 101, at least a part of the first feeding portion 16 and at least a part of the antenna element 18 are located in a region of at least one of the concave portion 41 and of an extension region 42. The extension region 42 is an example of a region interposed between a first extension reference line 31 of the first vertical edge side 21 extended upward and a second extension reference line 32 of the second vertical edge side 22 extended upward. An upper end of the extension region 42 coincides with the glass edge 11*a*.

When at least a part of the first feeding portion 16 and at least a part of the antenna element 18 are located in one region of at least one of the concave portion 41 and an extension region 42, an area of the region of the conductive body 13 in the planar view of the window glass 101 is not liable to be readily reduced by an arrangement of the first feeding part 16 and the antenna element 18. That is, the concave portion 41 and the extension region 42 are used as arrangement regions for the first feeding portion 16 and the antenna element 18. An area necessary for the region of the conductive body 13 can be easily secured. For example, when the conductive body 13 is, for example, a conductive film having thermal insulation properties, a region that can be insulated can be controlled against being reduced due to a reduction of the area of the conductive body 13.

In the planar view of the window glass 101, the first feeding portion 16 is arranged at a position closer to the first vertical edge side 21 than the horizontal edge side 23 of the concave portion 41. That is, in the planar view of the window glass 101, the shortest distance between the first feeding portion 16 and the first vertical edge side 21 is less than the shortest distance between the first feeding portion 16 and the horizontal edge side 23 of the concave portion 41.

In this way, because by arranging the first feeding portion 16 at a position closer to the first vertical edge side 21 than the horizontal edge side 23, the first feeding portion 16 is located adjacent to the first vertical edge side 21, it becomes possible to connect a wiring member, such as a coaxial cable, to the first feeding portion 16 so that the wiring member does not get in the way of attaching an electrical equipment product to the concave portion 41. The same applies to embodiments which will be described later with reference to FIGS. 2 to 7.

In the planar view of the window glass 101, the first feeding portion 16 is arranged at a position closer to an upper end 21*a* of the first vertical edge side 21 than the horizontal edge side 23 of the concave portion 41. That is, in the planar view of the window glass 101, the shortest distance between the first feeding portion 16 and the upper end 21*a* of the first vertical edge side 21 is less than the shortest distance between the first feeding portion 16 and the horizontal edge side 23 of the concave portion 41.

In this way, because by arranging the first feeding portion 16 at a position closer to the upper end 21*a* of the first vertical edge side 21 than the horizontal edge side 23, the first feeding portion 16 is located adjacent to the upper end 21*a*, it becomes possible to connect a wiring member, such as a coaxial cable, to the first feeding portion 16 so that the wiring member does not get in the way of attaching an electrical equipment product to the concave portion 41. The same applies to embodiments which will be described later with reference to FIGS. 2 to 7.

In FIG. 1, the window glass 101 may be provided with a shielding film 60 that shields at least a part of the antenna 1 and at least a part of the concave portion 41. The shielding film 60 is arranged between at least a part of the antenna 1 as well as at least a part of the concave portion 41 and the first glass plate 11. According to the above-described configuration, when the window glass is viewed from outside of the vehicle in a planar view, a part that overlaps with the shielding film 60 (at least a part of the antenna 1 and at least a part of the concave portion 41) is not liable to be seen. Then, a design quality of the window glass 101 is enhanced. The shielding film 60 is, for example, a ceramic formed on a surface of the first glass plate 11. Specifically, the shielding film 60 includes a sintered body of a black ceramic film or the like.

The shielding film 60 is, in a planar view of the window glass 101, formed between a shielding edge 61 and glass edges 11*a* to 11*d*. The shielding edge 61 is a film edge of the shielding film 60. In the case illustrated in FIG. 1, the shielding film 60 shields the first feeding portion 16, the antenna element 18, the concave portion 41 and the extension region 42.

Figure 2:
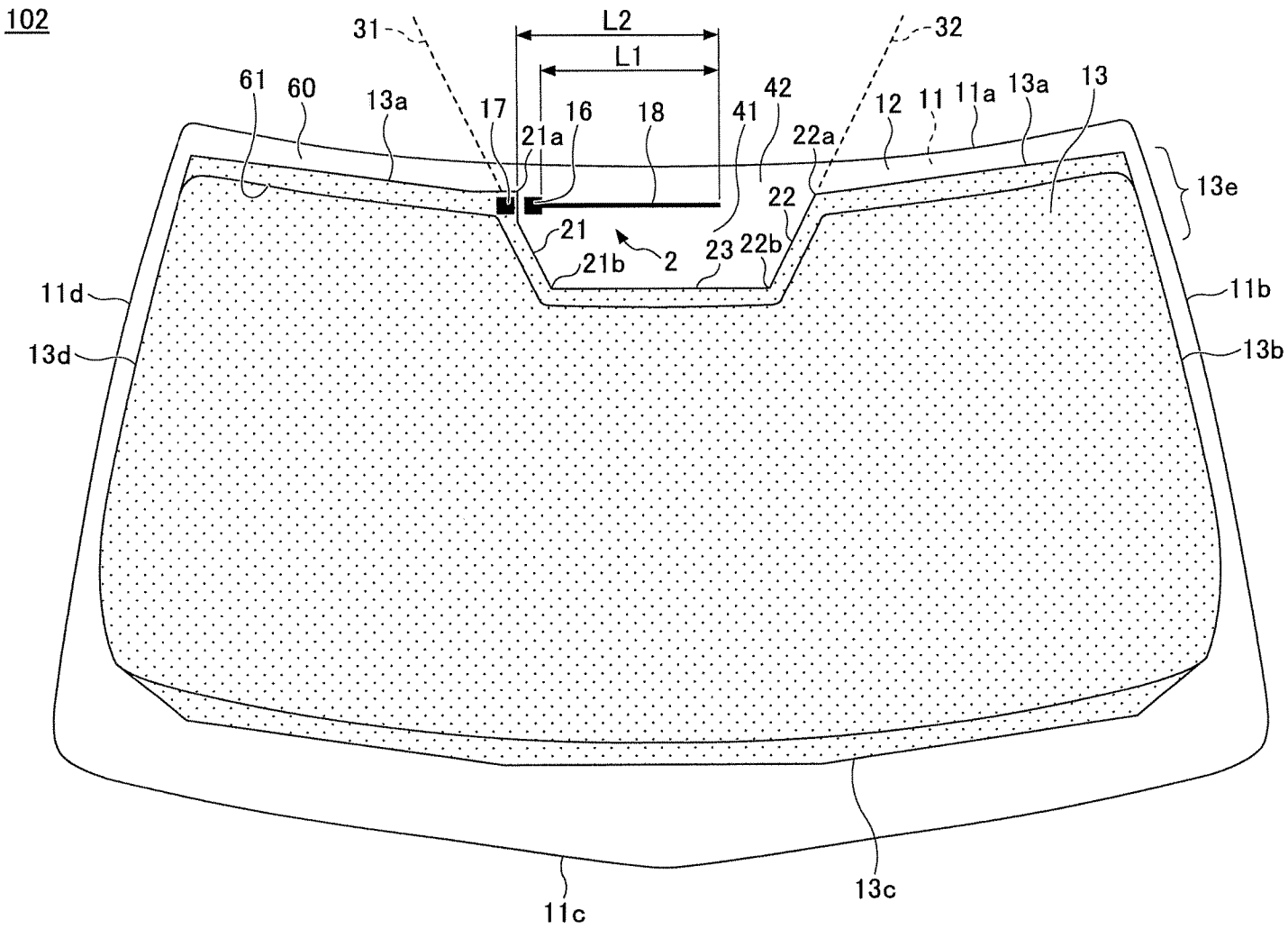
FIG. 2 is a plan view depicting another example of the configuration of the vehicle window glass.

FIG. 2 is a plan view illustrating, in a planar view, a window glass 102 according to another embodiment. Among configurations of the window glass 102, for description of the same configurations as that of the window glass 101, the above description of the configurations of the window glass 101 will be applied accordingly. The window glass 102 is provided with an antenna 2 with a different form from the antenna 1 of the window glass 101.

The antenna 2 includes a first feeding portion 16, a second feeding portion 17, and an antenna element 18. The antenna 2 is fed via the first feeding portion 16 and the second feeding portion 17. The first feeding portion 16 is electrically connected to the antenna element 18, and the second feeding portion 17 is electrically connected to an upper edge portion 13*e* of a conductive body 13.

Figure 14:
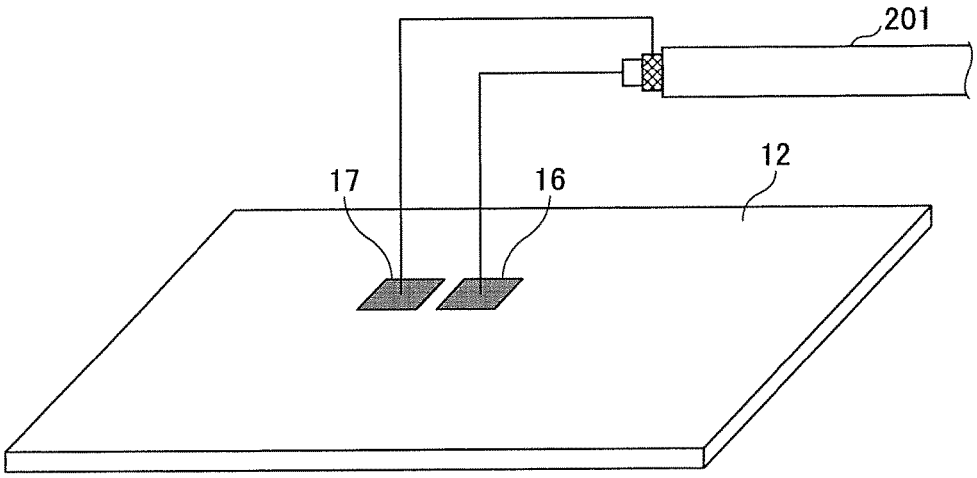
FIG. 14 is a diagram depicting another example of the connection of the coaxial cable.

The antenna 2 is a monopole antenna of a bipolar type that is provided with the first feeding portion 16 and the second feeding portion 17 as a pair of electrodes. In the case of the antenna 2, for example, as illustrated in FIG. 14, an inner conductive body of a coaxial cable 201 connected to a signal processing device including a reception circuit is electrically connected to the first feeding portion 16. An outer conductive body of the coaxial cable 201 is electrically connected to the second feeding portion 17. That is, the antenna 2 is a monopole antenna that uses the conductive body 13 as a ground.

The second feeding portion 17 is, for example, electrically connected to the upper edge portion 13*e* on the side of the first vertical edge side 21 with respect to the concave portion 41 (in the drawing, the upper edge portion 13*e* of the left side). According to the above-described configuration, the first feeding portion 16 and the second feeding portion 17 are close to each other, and one coaxial cable can be easily connected to the first feeding portion 16 and to the second feeding portion 17.

For example, the second feeding portion 17 may be electrically connected to the upper edge portion 13*e*, so that the first vertical edge side 21 passes between the first feeding portion 16 and the second feeding portion 17 in the planar view of the window glass 102. According to the above-described configuration, the first feeding portion 16 and the second feeding portion 17 are close to each other, and one coaxial cable can be easily connected to the first feeding portion 16 and to the second feeding portion 17. In addition, the first vertical edge side 21 may overlap with at least one of the first feeding portion 16 and the second feeding portion 17 in a planar view of the window glass 102.

In the case illustrated in FIG. 2, the shielding film 60 shields the first feeding portion 16, the second feeding portion 17, the antenna element 18, the concave portion 41 and the extension region 42.

Figure 3:
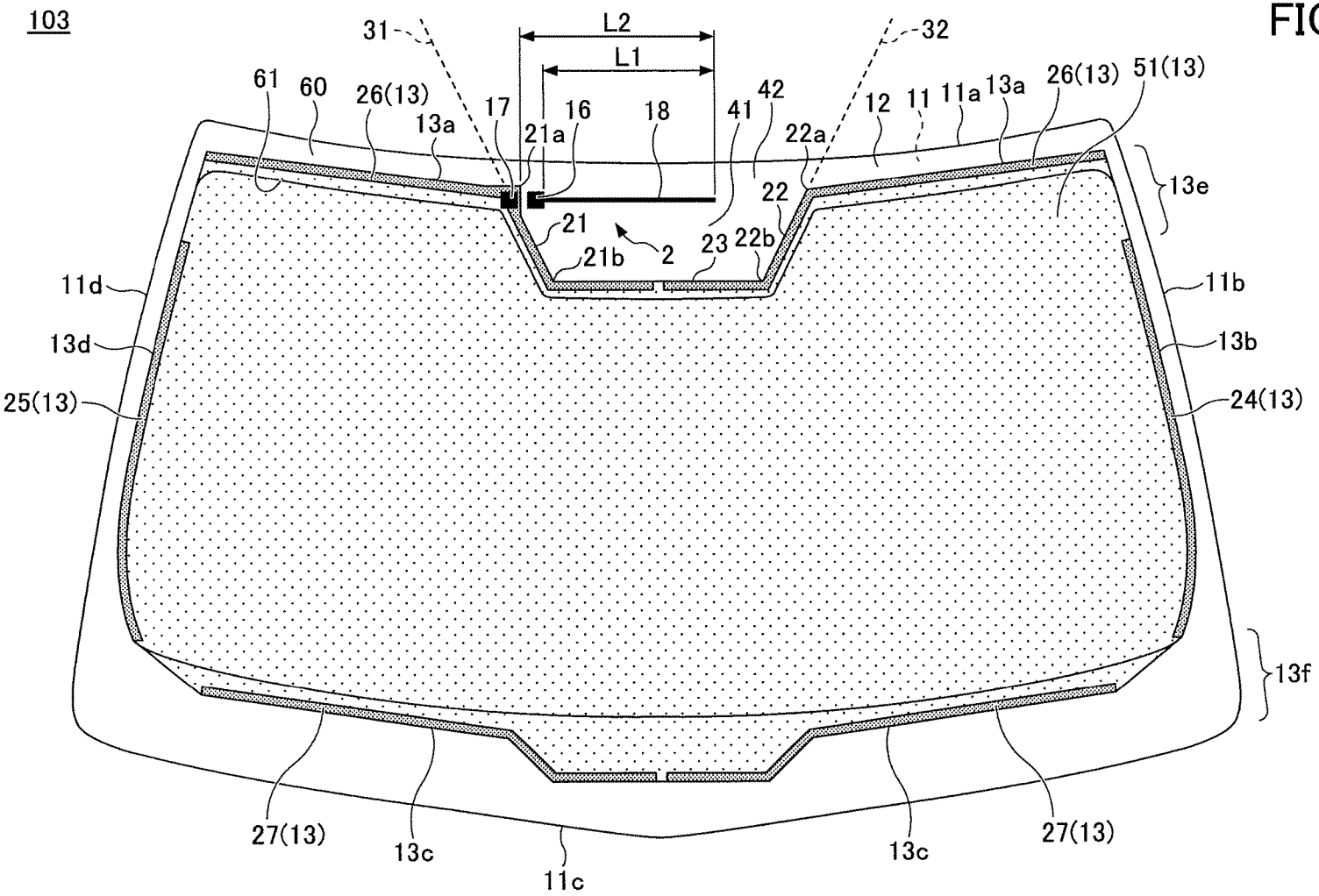
FIG. 3 is a plan view depicting another example of the configuration of the vehicle window glass.

FIG. 3 is a plan view illustrating, in a planar view, a window glass 103 according to yet another embodiment. Among configurations of the window glass 103, for description of the same configurations as that of the window glass 101 or 102, the above description of the configurations of the window glass 101 or 102 will be applied accordingly. The window glass 103 is provided with a conductive body 13 with a different form from that of the window glass 102.

The conductive body 13 is provided with an upper bus bar 26, a lower bus bar 27, and a conductive film 51. The upper bus bar 26 is an example of an upper band-like electrode arranged on an upper edge portion 13*e* of the conductive body 13. The lower bus bar 27 is an example of a lower band-like electrode arranged on a lower edge portion 13*f* of the conductive body 13. The conductive film 51 is an example of a conductive film that is conductively connected to the upper bus bar 26 and the lower bus bar 27 (a pair of bus bars 26, 27). The conductive film 51, for example, has an upper side that is connected to a lower side of the upper bus bar 26, and a lower side that is connected to an upper side of the lower bus bar 27. The upper bus bar 26 on the left includes the first vertical edge side 21 and a left part of the horizontal edge side 23, and the upper bus bar 26 on the right includes the second vertical edge side 22 and a right part of the horizontal edge side 23.

The conductive film 51 is, for example, a conductive body that heats the window glass 103. When an electric voltage is applied between the pair of bus bars 26, 27, and an electric current flows in the conductive film 51, the window glass 103 can thereby perform snow melting, ice melting, anti-fogging or the like. Alternatively, the conductive film 51 may be a conductive body that can detect a crack or the like in the window glass 103 by sensors attached between the pair of bus bars 26, 27 and monitoring variations of an electric voltage between the pair of bus bars 26, 27, an electric current, a resistance value or the like. Use and purpose of the conductive film 51 are not restricted.

When at least a part of the first feeding portion 16 and at least a part of the antenna element 18 are located in at least one of the concave portion 41 and the extension region 42, an area of the region of the conductive film 51 in the planar view of the window glass 101 is not liable to be readily reduced by an arrangement of the first feeding portion 16 and the antenna element 18. That is, because the concave portion 41 and the extension region 42 are used for a region where the first feeding portion 16 and the antenna element 18 are arranged, a necessary area for a region of the conductive film 51 can be easily secured. For example, a region that can be heated can be controlled against being reduced due to a reduction of the area of the conductive film 51.

In the case illustrated in FIG. 3, the upper bus bar 26 is divided into two, i.e. right and left. The upper bus bar 26 may be divided into three or more. The upper bus bar is not required to be divided. The same applies to the lower bus bar 27.

The pair of bus bars 26, 27 that face each other in the vertical direction are, for example, arranged by laminating on a surface on a vehicle interior side of the first glass plate 11 or on a surface on a vehicle exterior side of the second glass plate 12. When the window glass 103 is a laminated glass, the pair of bus bars 26, 27 may be arranged to be interposed between the first glass plate 11 and the second glass plate 12 that configure the laminated glass, or may be arranged to be interposed between an intermediate film and one of the glass plates. The pair of bus bars 26, 27 may be arranged in the same layer as the conductive film 51. The pair of bus bars 26, 27 may be arranged in a different layer from the conductive film 51, if a conductive connection to the conductive film is secured via auxiliary members.

In order to apply an electric voltage between the pair of bus bars 26, 27 for applying an electric current in the conductive film 51, in a state where the window glass 103 is installed on a vehicle, for example, a power supply unit is connected conductively to one bus bar, i.e. the upper bus bar 26, and a ground part is connected conductively to the other bus bar, i.e. the lower bus bar 27. The power supply unit is, for example, a positive electrode of a direct current power supply, such as a battery. The ground part is a negative electrode of the direct current power supply, such as a battery, or a vehicle body frame. Alternatively, the power supply unit may be connected to the lower bus bar 27 and the ground part may be connected to the upper bus bar 26.

A structure of electric connection of the pair of bus bars 26, 27 and the power supply unit and the ground part is not particularly limited. For example, when the pair of bus bars 26, 27 are laminated in the laminated glass, via electrode extraction parts such as copper foils drawn from an outer edge portion of the laminated glass, the pair of bus bars 26, 27 are electrically connected to the power supply unit and the ground part. Alternatively, the power supply unit and the ground part may be electrically connected to the pair of bus bars 26, 27 that are exposed by cutting out a part of one glass plate of the laminated glass.

The conductive body 13 may be provided with a right bus bar 24 and a left bus bar 25. The right bus bar 24 is an example of a right band-like electrode arranged on a right edge portion of the conductive body 13. The left bus bar 25 is an example of a left band-like electrode arranged on a left edge portion of the conductive body 13. The conductive film 51 is conductively connected to the right bus bar 24 and the left bus bar 25. The conductive film 51 includes, for example, a right side that is connected to the left side of the right bus bar 24, and a left side that is connected to the right side of the left bus bar 25. In the same way as above, when an electric voltage is applied between the right bus bar 24 and the left bus bar 25, an electric current flows in the conductive film 51, and thereby snow melting or the like on the window glass 103 can be performed.

In addition, the conductive body 13 may be provided with at least one of the pair of bus bars 26, 27 and the pair of bus bars 24, 25. The same applies to FIG. 6 which will be described later.

The second feeding portion 17 is, for example, electrically connected to the upper bus bar 26 on the side of the first vertical edge side 21 with respect to the concave portion 41 (in the drawing, upper bus bar 26 on the left). According to the above-described configuration, the first feeding portion 16 and the second feeding portion 17 are close to each other, and one coaxial cable can be easily connected to the first feeding portion 16 and to the second feeding portion 17. The second feeding portion 17 is electrically connected to at least one of the upper bus bar 26 and the conductive film 51.

In the case of the window glass illustrated in FIG. 3, the shielding film 60 shields the first feeding portion 16, the second feeding portion 17, the antenna element 18, the concave portion 41, the extension region 42, the upper bus bar 26 and the lower bus bar 27.

Figure 4:
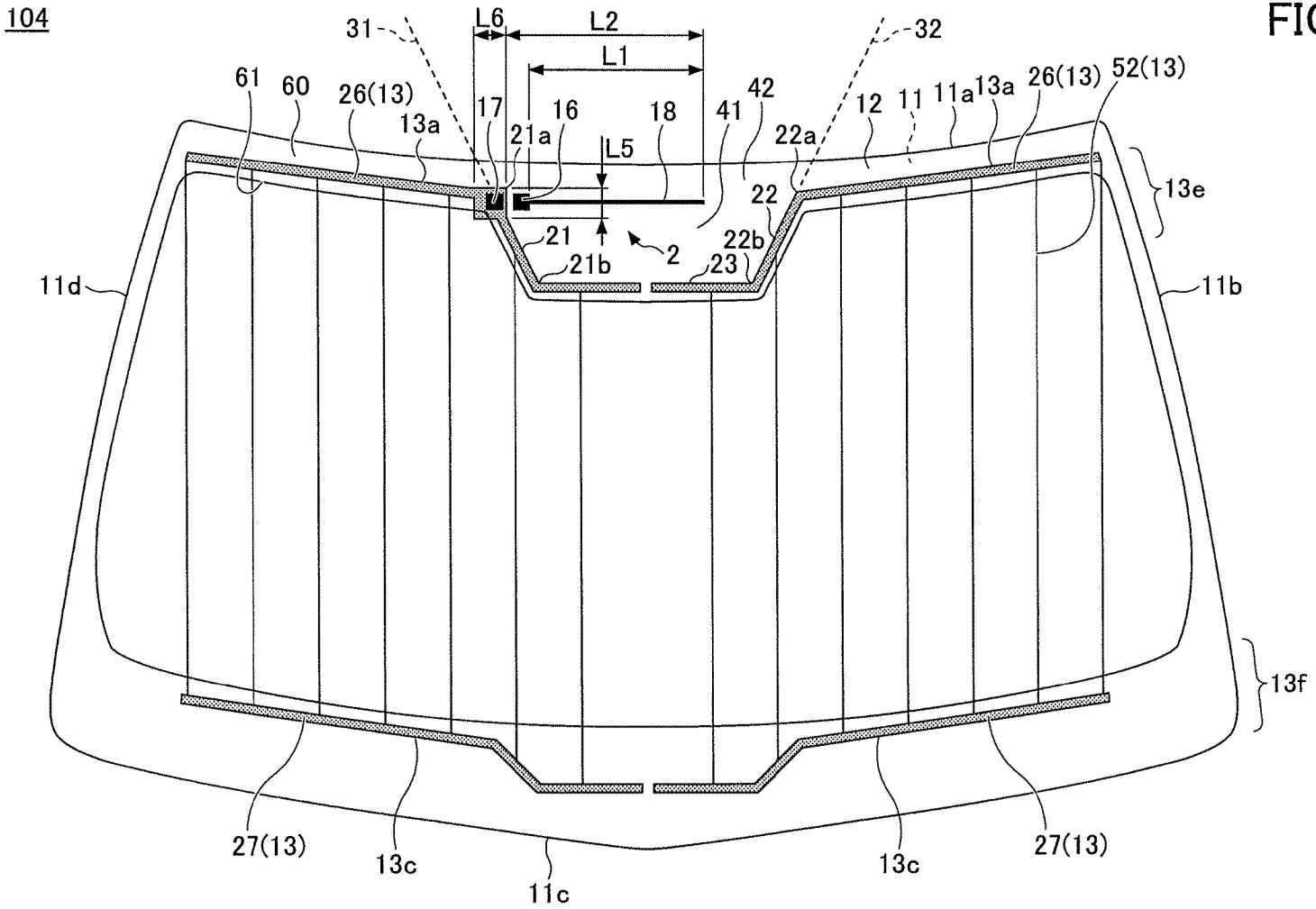
FIG. 4 is a plan view depicting yet another example of the configuration of the vehicle window glass.

FIG. 4 is a plan view illustrating, in a planar view, a window glass 104 according to still another embodiment. Among configurations of the window glass 104, for description of the same configurations as that of the window glasses 101 to 103, the above description of the configurations of the window glasses 101 to 103 will be applied accordingly. The window glass 104 is provided with a conductive body 13 with a different form from that of the window glass 103.

The conductive body 13 is provided with an upper bus bar 26, a lower bus bar 27, and a plurality of conductive lines 52. The conductive line 52 is an example of a conductive line that is conductively connected to the upper bus bar 26 and the lower bus bar 27 (the pair of bus bars 26, 27). Each of the plurality of conductive lines 52 has an upper end that is connected to the lower side of the upper bus bar 26 and a lower end that is connected to the upper side of the lower bus bar 27. An interval between the adjacent conductive lines 52 is selectable.

The plurality of conductive lines 52 are, for example, conductive bodies that heat the window glass 104. When an electric voltage is applied between the pair of bus bars 26, 27, and electric currents flow in the plurality of conductive lines 52, the window glass 104 can thereby perform snow melting, ice melting antifogging or the like. Alternatively, the plurality of conductive lines 52 may be conductive bodies that can detect a crack of the like in the window glass 104 by sensors attached between the pair of bus bars 26, 27 and monitoring variations of an electric voltage between the pair of bus bars 26, 27, electric currents, resistance values or the like. Use and purpose of the conductive lines 52 are not restricted.

When at least a part of the first feeding portion 16 and at least a part of the antenna element 18 are located in at least one of the concave portion 41 and the extension region 42, an area of the region in which the conductive lines 52 are wired in the planar view of the window glass 101 is not liable to be readily reduced by an arrangement of the first feeding portion 16 and the antenna element 18. That is, because the concave portion 41 and the extension region 42 are used for a region where the first feeding portion 16 and the antenna element 18 are arranged, a necessary area for a wiring region of the conductive lines 52 can be easily secured. For example, a region that can be heated can be controlled against being reduced due to a reduction of the area of the wiring region of the conductive lines 52.

Figure 5:
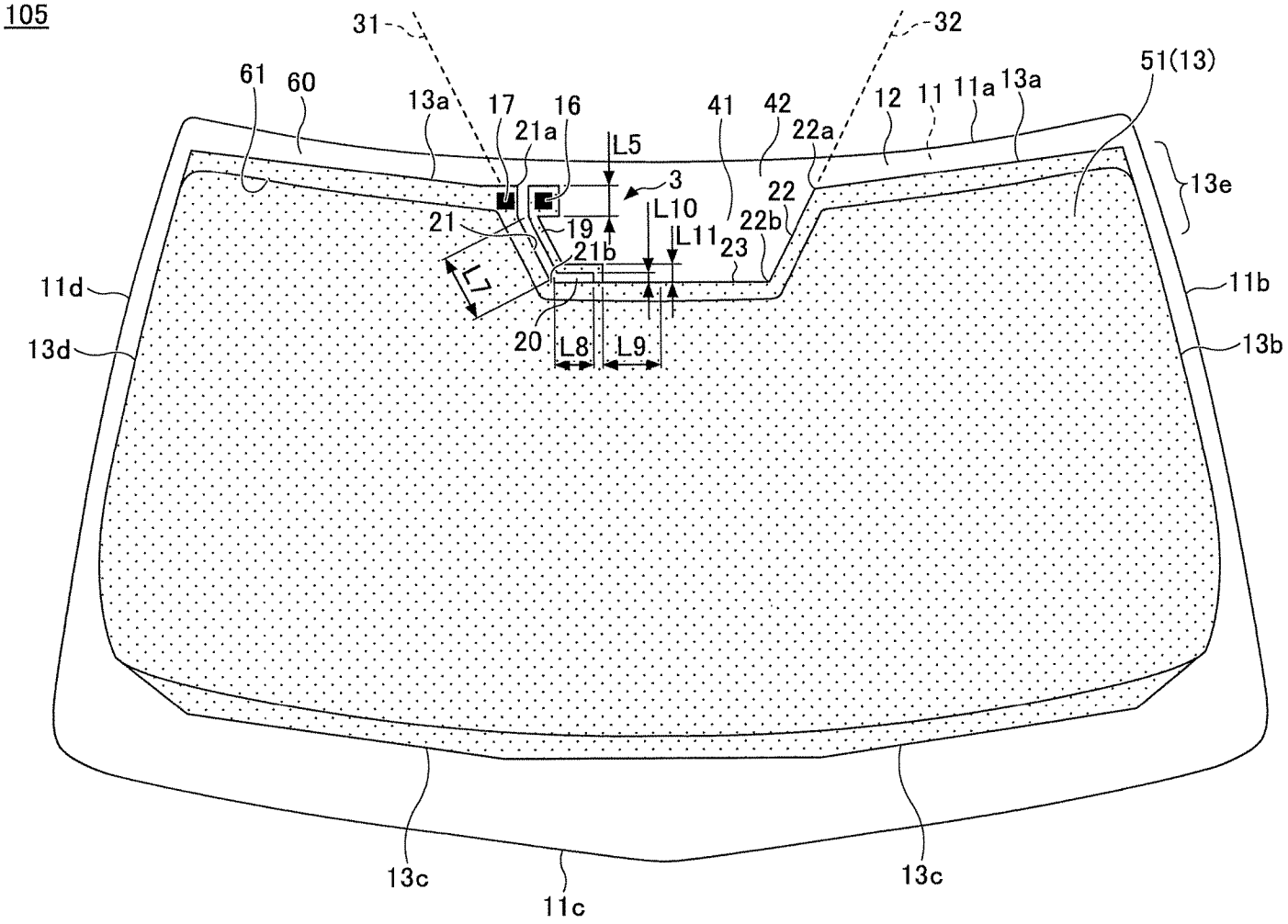
FIG. 5 is a plan view depicting still another example of the configuration of the vehicle window glass.

FIG. 5 is a plan view illustrating, in a planar view, a window glass 105 according to yet another embodiment. Among configurations of the window glass 105, for description of the same configurations as that of the window glass 101 or 102, the above description of the configurations of the window glass 101 or 102 will be applied accordingly. The window glass 105 is provided with an antenna 3 with a different form from the antenna 2 of the window glass 102.

The antenna 3 includes a first feeding portion 16, a second feeding portion 17, an antenna element 19 and a slot 20. The antenna 3 is fed via the first feeding portion 16 and the second feeding portion 17. The first feeding portion 16 is electrically connected to the antenna element 19, and the second feeding portion 17 is electrically connected to an upper edge portion 13*e* of a conductive body 13. The antenna element 19 and the slot 20 are arranged on the concave portion 41.

The antenna 3 is a slot antenna including a slot 20 formed between the antenna element 19 and a first vertical edge side 21. The slot 20 also includes a slot part formed between the antenna element 19 and a horizontal edge side 23. A tip of the antenna element 19, on the side opposite to the first feeding portion 16, is electrically connected to the conductive body 13 on the horizontal edge side 23.

The antenna 3 is a slot antenna of a bipolar type that is provided with the first feeding portion 16 and the second feeding portion 17 as a pair of electrodes. In the case of the antenna 3, for example, an inner conductive body of a coaxial cable connected to a signal processing device including a reception circuit is electrically connected to the first feeding portion 16. An outer conductive body of the coaxial cable is electrically connected to the second feeding portion 17.

In the planar view of the window glass 105, the slot 20 goes through a gap between the first feeding portion 16 and the second feeding portion 17, and the slot 20 has an open end that opens upwardly at the upper outer edge 13*a* of the conductive body 13.

In the planar view of the window glass 105, at least a part of the first feeding portion 16 and at least a part of the antenna device 19 are located in one region of at least one of the concave portion 41 and the extension region 42.

In the case illustrated in FIG. 5, the shielding film 60 shields the first feeding portion 16, the second feeding portion 17, the antenna element 19, the concave portion 41 and the extension region 42.

Figure 6:
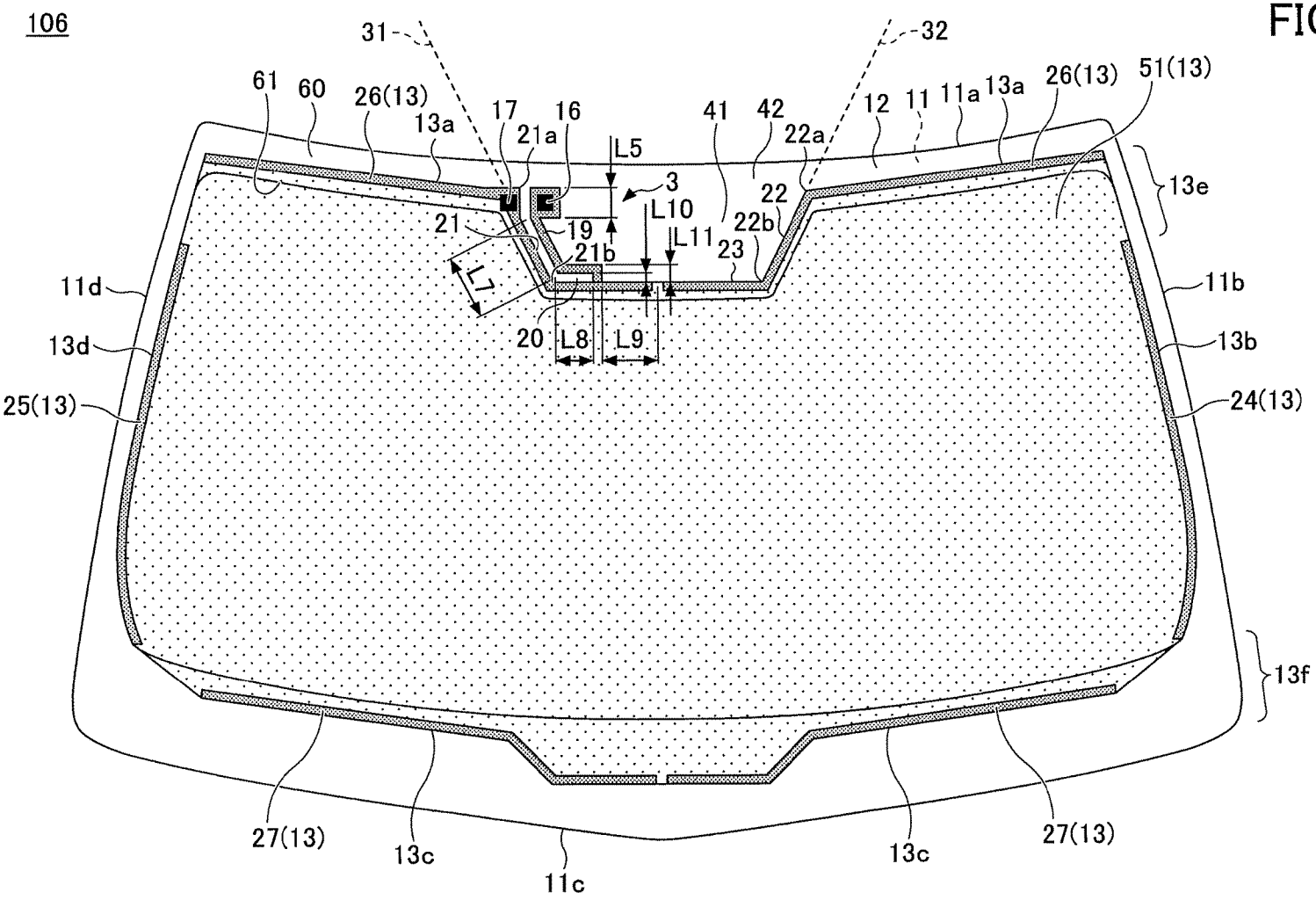
FIG. 6 is a plan view depicting yet another example of the configuration of the vehicle window glass.

FIG. 6 is a plan view illustrating, in a planar view, a window glass 106 according to still another embodiment. Among configurations of the window glass 106, for description of the same configurations as that of the window glass 103 or 105, the above description of the configurations of the window glass 103 or 105 will be applied accordingly. The window glass 106 is obtained by replacing the antenna 2 in the configuration of the window glass 103 by the antenna 3 illustrated in FIG. 5.

In FIG. 6, a tip of the antenna element 19, on the side opposite to the first feeding portion 16, is electrically connected to the left upper bus bar 26 of the conductive body 13 on the horizontal edge side 23.

The pair of bus bars 26, 27 (particularly, the upper bus bar 26 to which at least a part of the second feeding portion 17 is electrically connected) have smaller sheet electric resistances (also referred to as surface resistivity, unit is Ω) than the conductive film 51. For the pair of bus bars 26, 27, for example, a metal foil, such as copper or silver, or a thin film having smaller sheet electric resistance than the conductive film 51 is used.

Because at least a part of a conductive body that surrounds the slot 20 is formed of the upper bus bar 26 having a smaller electric resistance than the conductive film 51, an electric current is more easily excited along the slot 20. According to the above-described property, an antenna gain can be enhanced compared with an antenna in which a slot is formed only with a conductive film 51.

Figure 7:
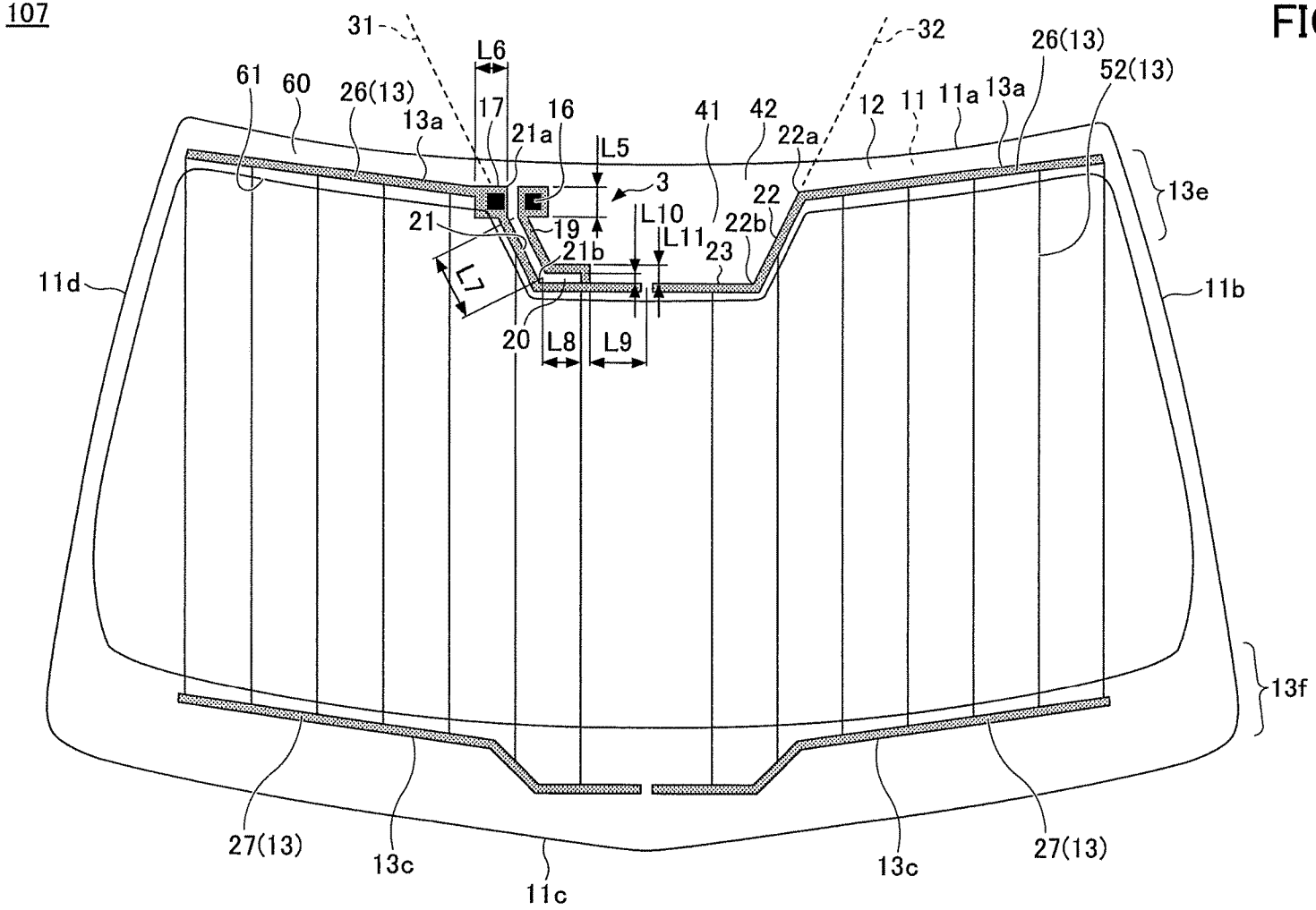
FIG. 7 is a plan view depicting still another example of the configuration of the vehicle window glass.

FIG. 7 is a plan view illustrating, in a planar view, a window glass 107 according to yet another embodiment. Among configurations of the window glass 107, for description of the same configurations as that of the window glass 104 or 105, the above description of the configurations of the window glass 104 or 105 will be applied accordingly. The window glass 107 is obtained by replacing the antenna 2 in the configuration of the window glass 104 by the antenna 3 illustrated in FIG. 5.

In FIG. 7, a tip of the antenna element 19, on the side opposite to the first feeding portion 16, is electrically connected to the left upper bus bar 26 of the conductive body 13 on the horizontal edge side 23.

In each of FIGS. 1 to 7, forms of the antenna element, the feeding portion and the slot (shape, dimension, or the like) only have to be set so as to satisfy the required value of the antenna gain necessary for receiving electric waves of the frequency band to be received by the antenna. For example, in the case where the frequency band to be received by the antenna is the digital terrestrial television broadcasting band of 470 MHz to 710 MHz, the antenna elements and the like are formed so as to be adapted to the reception of electric waves of the digital terrestrial television broadcasting band of 470 MHz to 710 MHz.

In each of FIGS. 2 to 7, for example, when the first feeding portion 16 is set to be an electrode on the signal line side and the second feeding portion 17 is set to be an electrode on the grounding line side, the first feeding portion 16 is conductably connected to a signal line that is coupled to a signal processing device (e.g. an amplifier) mounted on the vehicle body side, and the second feeding portion 17 is conductably connected to a grounding line coupled to a ground portion on the vehicle body side. The ground portion on the vehicle body side includes, for example, a body ground, a ground of a signal processing device, to which a signal line connected to the first feeding portion 16 is coupled, or the like. In addition, the first feeding portion 16 may be set to be the electrode of the ground line side, and the second feeding portion 17 may be the electrode on the signal line side.

The reception signal for the electric waves received by the antenna is transferred to the signal processing device mounted on the vehicle via a conductive member energizably connected to the first feeding portion 16 or a pair of feeding portions 16, 17. As the conductive member, a feeding line such as an AV line or a coaxial cable may be used.

In the case of using a coaxial cable for a feeding line for feeding the antenna via the first feeding portion 16 or the pair of feeding portions 16, 17, for example, an inner conductive body of the coaxial cable only has to be electrically connected to the first feeding portion 16, and an outer conductive body of the coaxial cable only has to be connected to the vehicle body or the second feeding portion 17. Moreover, a configuration in which a connector for electrically connecting a conductive member, such as a conductive line, connected to the signal processing device and the first feeding portion 16 or the pair of feeding portions 16, 17 for implementation in the first feeding portion 16 or the pair of feeding portions 16, 17, may be employed. According to such a connector, it becomes easy to attach an inner conductive body of a coaxial cable to the first feeding portion 16, and it becomes easy to attach an outer conductive body of the coaxial cable to the second feeding portion 17. Furthermore, the antenna may have a configuration in which a projection-shaped conductive member is arranged on the first feeding portion 16 or the pair of feeding portions 16, 17, and the projection-shaped conductive member contacts and is engaged with a feeding portion arranged on a flange portion of the vehicle to which a window glass is attached.

A shape of the first feeding portion 16 or the pair of feeding portions 16, 17 and an interval among the respective feeding portions may be determined taking into account a shape of a mounting surface of the above-described conductive member or the connector, or an interval of the mounting surfaces. For example, a rectangular shape or a polygonal shape such as a square, an approximate square, a rectangle, or an approximate rectangle is preferable in mounting. In addition, the shape may be a circular shape, such as a circle, an approximate circle, an ellipse, or an approximate ellipse.

Moreover, the first feeding portion 16 or the pair of feeding portions 16, 17 is formed, for example, by printing a paste containing a conductive metal, such as a silver paste, on a surface of the second glass plate 12 on the internal vehicle side, and by plating the paste. However, the forming method is not limited to the above-described method. A line-shaped body or a foil-shaped body configured with a conductive material, such as copper, may be formed on a surface of the second glass plate 12 on the internal vehicle side, or adhered to the second glass plate 12 by an adhesive agent or the like.

FIGS. 8 to 12 illustrate variations of a stacking form of the window glass according to the embodiment. In FIGS. 8 to 12, the conductive body 13 is arranged between the first glass plate 11 and a dielectric body (the second glass plate 12 or the dielectric substrate 33). The conductive body 13 includes at least any of the above-described conductive film 51, the conductive line 52, and the upper bus bar 26.

Figure 8:
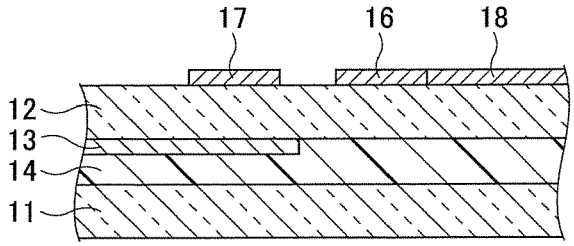
FIG. 8 is a partial cross-sectional view depicting an example of a cross section of the vehicle window glass.
Figure 9:
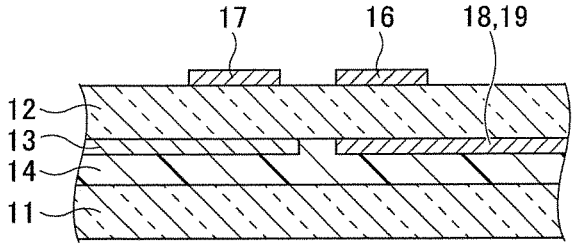
FIG. 9 is a partial cross-sectional view depicting another example of the cross section of the vehicle window glass.
Figure 10:
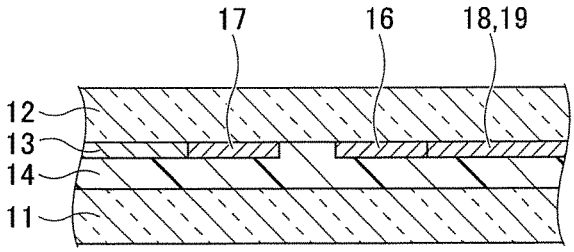
FIG. 10 is a partial cross-sectional view depicting yet another example of the cross section of the vehicle window glass.

In the case illustrated in FIGS. 8 to 10, the conductive body 13 and the intermediate film 14 are arranged between the first glass plate 11 and the second glass plate 12. The first glass plate 11 and the second glass plate 12 are bonded via the intermediate film 14. The intermediate film 14 is, for example, a thermoplastic polyvinyl butyral. A relative permittivity $\in_r$ of the intermediate film 14 is, for example, 2.8 or more and 3.0 or less, which is a value of the relative permittivity of a typical intermediate film of a laminated glass.

In FIG. 8, the first feeding portion 16, the second feeding portion 17 and the antenna element 18 are formed by printing on the surface on the vehicle internal side of the second glass plate 12 (surface opposite to the first glass plate 11). The conductive body 13 is coated by a vapor deposition process on a surface of the second glass plate 12 on the first glass plate 11 side. Because the first feeding portion 16 is connected to the antenna element 18 in a direct current manner, the first feeding portion 16 is electrically connected to the antenna element 18. The second feeding portion 17 is opposite to the upper edge portion 13*e* of the conductive body 13 via the second glass plate 12 that is a dielectric body. According to the above-described configuration, the second feeding portion 17 is capacitively coupled to the upper edge portion 13*e* of the conductive body 13, and thereby the second feeding portion 17 is electrically connected to the upper edge portion 13*e* of the conductive body 13.

When the second feeding portion 17 is capacitively coupled to the upper edge portion 13*e* of the conductive body 13, noise of a frequency band that cannot be capacitively coupled is filtered, and thereby a noise of the conductive body 13 can be reduced. The same applies to another stacking form that will be described later (for example, FIGS. 9, 11, 12, and the like).

In FIG. 9, the first feeding portion 16 and the second feeding portion 17 are formed by printing on the surface on the vehicle internal side of the second glass plate 12. The conductive body 13 and antenna elements 18, 19 are coated by a vapor deposition process on a surface of the second glass plate 12 on the first glass plate 11 side. The first feeding portion 16 is opposite to the antenna elements 18, 19 via the second glass plate 12 that is a dielectric body. According to the above-described configuration, the first feeding portion 16 is capacitively coupled to the antenna elements 18, 19, and thereby the first feeding portion 16 is electrically connected to the antenna elements 18, 19. Similarly, the second feeding portion 17 is capacitively coupled to the upper edge portion 13*e* of the conductive body 13, and thereby the second feeding portion 17 is electrically connected to the upper edge portion 13*e* of the conductive body 13.

In FIG. 10, the conductive body 13, the first feeding portion 16, the second feeding portion 17, and the antenna elements 18, 19 are coated by a vapor deposition process on a surface of the second glass plate 12 on the first glass plate 11 side. Because the first feeding portion 16 is connected to the antenna elements 18, 19 in a direct current manner, the first feeding portion 16 is electrically connected to the antenna elements 18, 19. Because the second feeding portion 17 is connected to the conductive body 13 in a direct current manner, the second feeding portion 17 is electrically connected to the conductive body 13. The first feeding portion 16 and the second feeding portion 17 are connected to conductive members for feeding outside the window glass via conductive harnesses, respectively.

In addition, in FIGS. 8 to 10, any of the conductive body 13, the first feeding portion 16, the second feeding portion 17, and the antenna elements 18, 19 may be interposed between the two intermediate films, or coated by a vapor deposition process on the surface of the first glass plate 11 on the second glass plate 12 side.

Moreover, for example, in FIGS. 8 and 9, the upper bus bar 26 is interposed between the conductive film 51 and the intermediate film 14 in the stacking direction (direction in a planar view of the window glass), and is connected to the conductive film 51 in a direct current manner. The same applies to other bus bars, such as the lower bus bar 27. For example, in FIGS. 8 and 9, the conductive line 52 is interposed between the pair of upper bus bars that are arranged in the stacking direction, and connected to the upper bus bar 26 in a direct current manner.

Figure 11:
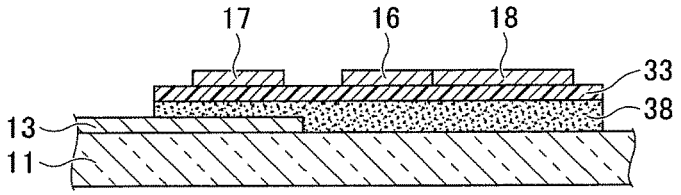
FIG. 11 is a partial cross-sectional view depicting still another example of the cross section of the vehicle window glass.
Figure 12:
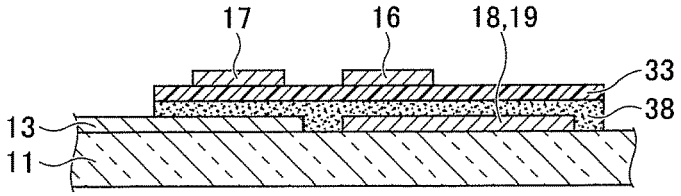
FIG. 12 is a partial cross-sectional view depicting yet another example of the cross section of the vehicle window glass.

As illustrated in FIGS. 11 and 12, the vehicle glass according to the embodiment need not be a laminated glass. In this case, the dielectric body may not be the same size as the first glass plates, and may be a dielectric substrate having a size to the extent that the first feeding portion 16 or the pair of feeding portions 16, 17 can be formed. In the case illustrated in FIGS. 11 and 12, the conductive body 13 is arranged between the first glass plate 11 and the dielectric substrate 33.

The dielectric substrate 33 is, for example, a resin substrate. The first feeding portion 16 or the pair of feeding portions 16, 17 are arranged on the dielectric substrate 33. The dielectric substrate 33 may be a print substrate of resin on which the first feeding portion 16 or the pair of feeding portions 16, 17 are printed (e.g. a glass epoxy substrate in which a copper foil is attached to FR4). The antenna element 18 may be arranged on the dielectric substrate 33 by a print process or the like.

FIG. 11 illustrates a form in which the conductive body 13 is coated on the first glass plate 11 by a vapor deposition process for the conductive body 13 on a surface of the first glass plate 11 on the dielectric substrate 33 side. The conductive body 13 and the first glass plate 11, and dielectric substrate 33 are bonded to each other by a bonding layer 38.

FIG. 12 illustrates a form in which the conductive body 13 and the antenna elements 18, 19 are coated on the first glass plate 11 by a vapor deposition process for the conductive body 13 and the antenna elements 18, 19 on the surface of the first glass plate 11 on the dielectric substrate 33 side. The dielectric substrate 33 is bonded to the conductive body 13, the first glass plate 11, and the antenna elements 18, 19 by the bonding layer 38.

As described above, the vehicle window glass and antenna have been described by embodiments, but the present invention is not limited to the above-described embodiments. A variety of variations and improvements such as combinations or replacements with a part of or the entirety of the other embodiments are possible within the present invention.

For example, in the form of FIG. 3 or 4, the antenna 2 may be replaced by the antenna 1.

Moreover, the antenna element or slots is not limited to a shape of straight line. The antenna element or slots may have a shape including a bending part such as an L-shape, an F-shape, a U-shape, or a meander shape.

Moreover, the position of the first feeding portion is not limited to the position adjacent to the upper end of the first vertical edge side. The first feeding portion may be located adjacent to the upper end of the second vertical edge side.

Figure 15:
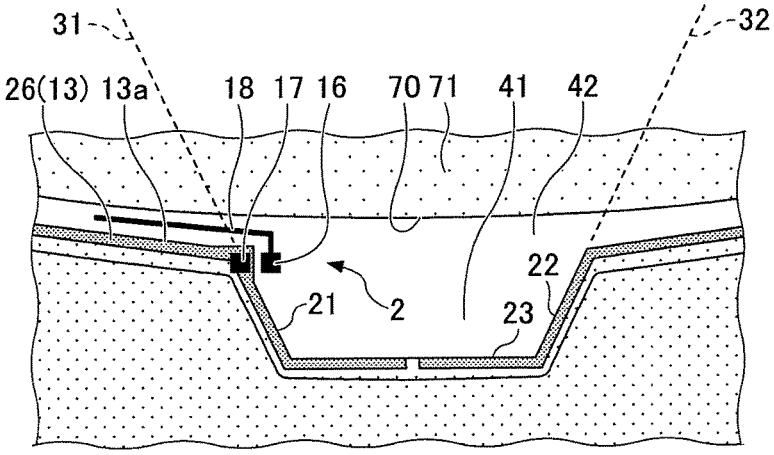
FIG. 15 is a plan view depicting an example of an antenna.

For example, as illustrated in FIG. 15, at least a part of the antenna element 18, in a planar view of the window glass, may be located between the upper outer edge 13*a* of the conductive body 13 and a lower end 70 of a flange portion 71 of the vehicle body, or may be located outside the concave portion 41 and the extension region 42. The flange portion 71 is a vehicle body site to which the window glass is attached.

Figure 16:
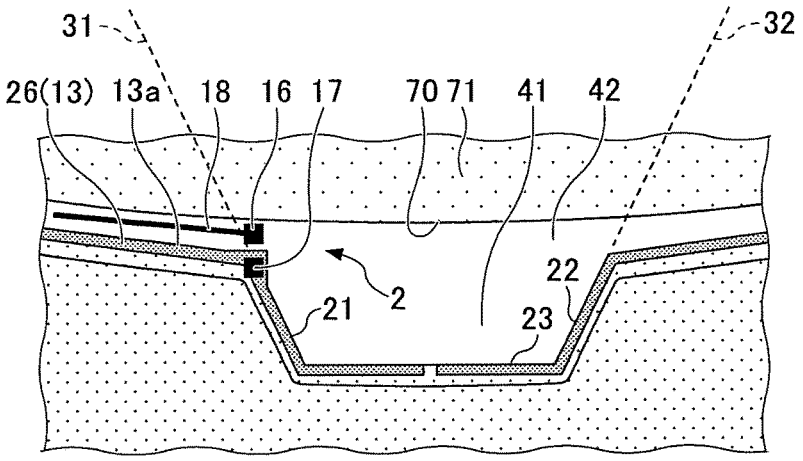
FIG. 16 is a plan view depicting another example of the antenna.

For example, as illustrated in FIG. 16, at least a part of the first feeding portion 16 may be located, in a planar view of the window glass, between the upper outer edge 13*a* of the conductive body 13 and the lower end 70 of the flange portion 71, or may be located outside the concave portion 41 and the extension region 42.

Figure 17:
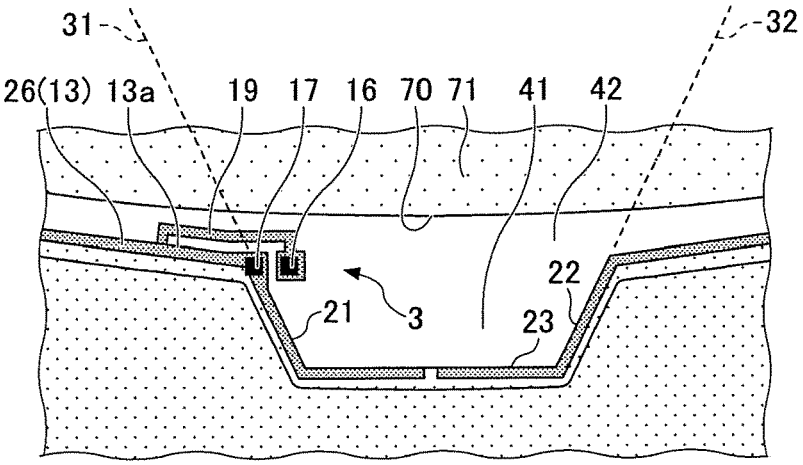
FIG. 17 is a plan view depicting yet another example of the antenna.

For example, as illustrated in FIG. 17, at least a part of the antenna element 19, in a planar view of the window glass, may be located between the upper outer edge 13*a* of the conductive body 13 and the lower end 70 of the flange portion 71, or may be located outside the concave portion 41 and the extension region 42. A tip of the antenna element 19, on the side opposite to the first feeding portion 16, is electrically connected to the upper bus bar 26 on the left of the conductive body 13 at the upper outer edge 13*a*.

Figure 18:
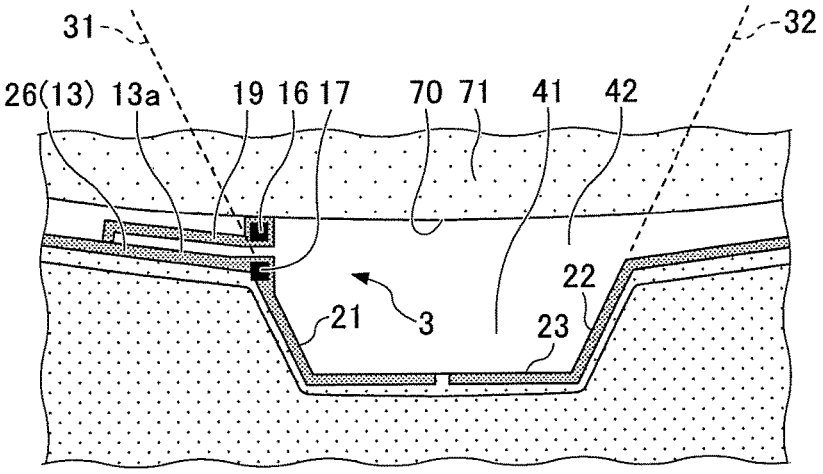
FIG. 18 is a plan view depicting still another example of the antenna.

For example, as illustrated in FIG. 18, at least a part of the first feeding portion 16 may be located, in a planar view of the window glass, between the upper outer edge 13*a* of the conductive body 13 and the lower end 70 of the flange portion 71, or may be located outside the concave portion 41 and the extension region 42. A tip of the antenna element 19, on the side opposite to the first feeding portion 16, is electrically connected to the upper bus bar 26 on the left of the conductive body 13 at the upper outer edge 13*a*.

Practical Example 1

In the following, results of measurements of antenna gains for the glass antennas of the window glasses 103, 104, 106 and 107 illustrated in FIGS. 3, 4, 6 and 7 assembled into front window frames of actual vehicles respectively, will be described.

The vehicle window glass, in which the antenna was formed, was assembled in a window frame of a car on a turn table in a state where a part of the antenna was tilted by about 25° with respect to the horizontal plane, and the antenna gain was measured. A connector was attached so that an inner conductive body of a coaxial cable was connected to the first feeding portion 16 and an outer conductive body of the coaxial cable was connected to the second feeding portion 17, and the pair of feeding portions 16, 17 was connected to a network analyzer via the coaxial cable. The turn table rotated so that the window glass was irradiated with electric waves from all directions in the horizontal direction.

The measurement of antenna gain was performed by setting the vehicle center of the car, in which the vehicle window glass with the formed antenna was assembled, to the center of the turn table, and rotating the car by 360°. Data of antenna gain were measured, for each rotation angle of 1°, and for each 3 MHz, within a frequency range (174 MHz to 240 MHz) of the band III of the digital audio broadcasting (DAB). Moreover, data of antenna gain were measured, for each rotation angle of 5°, and for each approximate 1.7 MHz, within a frequency range (1452 MHz to 1490 MHz)

of the L band of digital audio broadcasting (DAB). An elevation angle between a transmission position of electric waves and the antenna was measured in an approximately horizontal direction (in a direction where the elevation angle was 0°, which is the case where the elevation angle of a plane parallel to the ground surface was 0° and the elevation angle of the zenith direction was 90°). The antenna gain was standardized, with a half wavelength dipole antenna as a standard, so that an antenna gain of the half wavelength dipole antenna was 0 dB.

In the window glass 103 illustrated in FIG. 3, dimensions of the respective parts upon measuring antenna gain of the antenna 2 are (in units of mm)

L1: 220, and

L2: 252.

L1 is a length of the antenna element 18. L2 is a length of a horizontal direction component from an upper left end 21*a* to the tip of the antenna element 18.

In the window glass 104 illustrated in FIG. 4, dimensions of the respective parts upon measuring antenna gain of the antenna 2 are (in units of mm)

L1: 234,

L2: 264,

L5: 30, and

L6: 30.

L5 is a length of a vertical direction component of a conductive part in which a feeding portion is arranged.

L6 is a length of a horizontal direction component of the conductive part in which the feeding portion is arranged.

In the window glass 106 illustrated in FIG. 6, dimensions of the respective parts upon measuring antenna gain of the antenna 3 are (in units of mm)

L5: 30,

L7: 92,

L8: 55,

L9: 66,

L10: 10, and

L11: 20.

L7 is a length of a part of the antenna element 19 along the first vertical edge side 21. L8 is a length of a part of the antenna element 19 along the horizontal edge side 23. L9 is a length from a connection portion of the antenna element 19 and the horizontal edge side 23 to a central portion of the horizontal edge side 23. L10 is a slot width of the slot 20. L11 is a length in a vertical direction from an upper edge of a part of the antenna element 19 in the direction along the horizontal edge side 23 to the horizontal edge side 23.

In the window glass 107 illustrated in FIG. 7, dimensions of the respective parts upon measuring antenna gain of the antenna 3 are (in units of mm)

L5: 30,

L6: 30,

L7: 92,

L8: 55,

L9: 66,

L10: 10, and

L11: 20.

In FIGS. 3, 4, 6 and 7, any of the shapes of the first feeding portion 16 and the second feeding portion 17 is a square with a side 20 mm long. In FIGS. 3 and 4, the shortest distance between the first feeding portion 16 and the second feeding portion 17 is 10 mm. In FIGS. 6 and 7, the shortest distance between the first feeding portion 16 and the second feeding portion 17 is 14 mm. A line width of the antenna element 18 is 0.8 mm. Any of plate thicknesses of the first glass plate 11 and the second glass plate 12 is 2 mm. A thickness of the intermediate film 14 is 30 mils. Upon measuring antenna gain, the conductive body 13 was substituted by a copper foil.

In the window glasses 103 and 104, an inner conductive body of a coaxial cable is connected to the first feeding portion 16, and an outer conductive body of the coaxial cable is connected to the second feeding portion 17. In the window glasses 106 and 107, an outer conductive body of a coaxial cable is connected to the first feeding portion 16, and an inner conductive body of the coaxial cable is connected to the second feeding portion 17. Moreover, upon measuring antenna gain, the outer conductive body of the coaxial cable is threadably mounted on the body of the car at a position of 180 mm from a connector that is implemented in the pair of feeding portions 16, 17. The connector is a part for connecting a tip of a coaxial cable to the pair of feeding portions 16, 17.

The structure of lamination of the window glasses 103 and 104 is as illustrated in FIG. 8. The structure of lamination of the window glasses 106 and 107 is as illustrated in FIG. 9.

Figure 19:
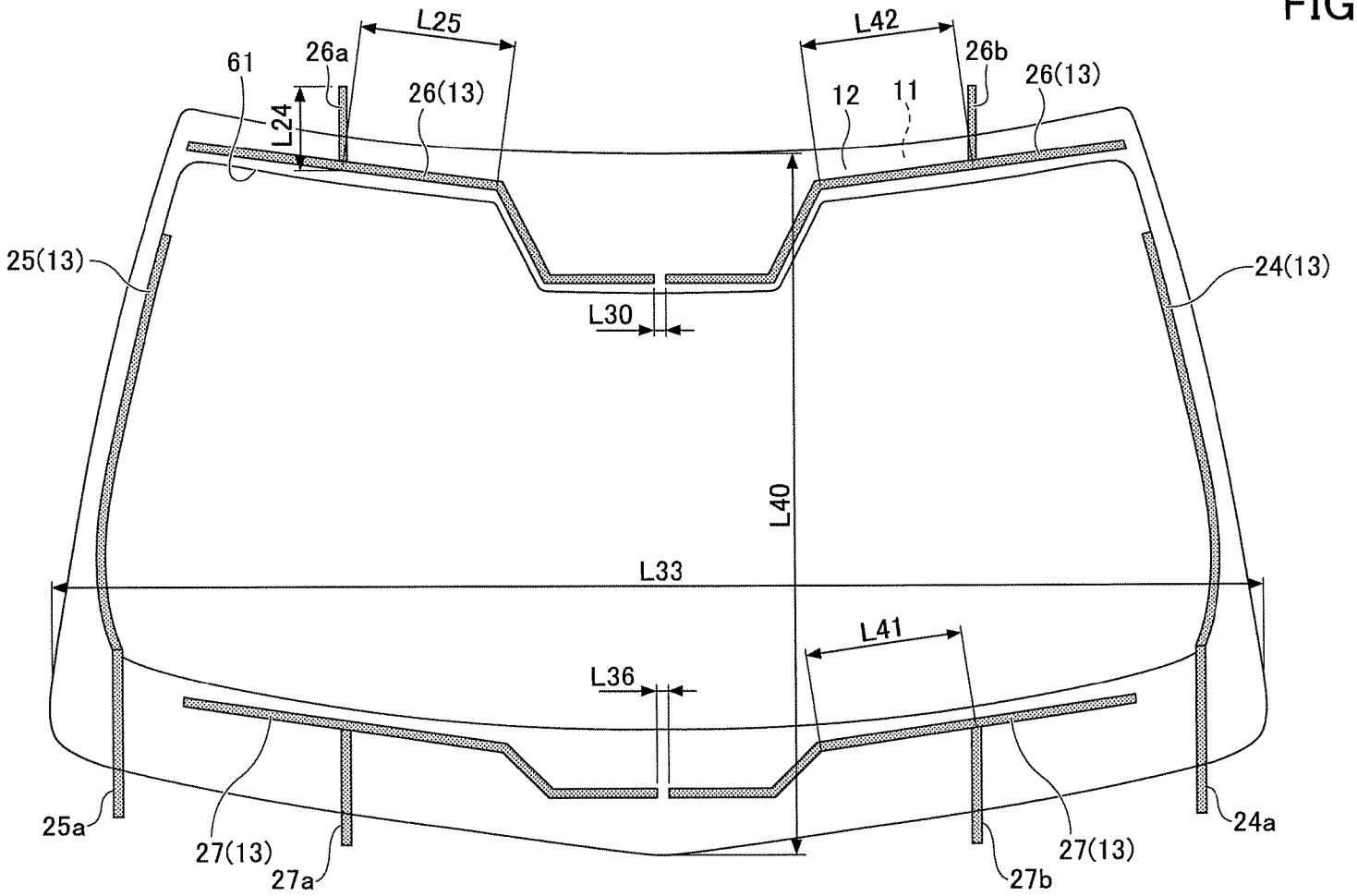
FIG. 19 is a plan view depicting an example of a configuration of a vehicle window glass.

FIG. 19 is a diagram indicating dimensions of the respective parts of each of the antennas illustrated in FIGS. 3, 4, 6 and 7 upon measuring antenna gain. The respective dimensions are (in units of mm)

L24: 240,

L25: 191,

L30: 5,

L33: 1491,

L36: 5,

L40: 825,

L41: 200, and

L42: 191.

L24 is a length of a bus bar extraction portion 26*a*. L25 is a length from a connection portion of the bus bar extraction portion 26*a* and the upper bus bar 26 to an upper end of a left vertical edge side of the concave portion. L30 is a gap distance between a left end of the right upper bus bar 26 and a right end of the left upper bas bar 26. L33 is the greatest external dimension of the window glass in the horizontal direction. L36 is a gap distance between a left end of the right lower bus bar 27 and a right end of the left lower bus bar 27. L40 is an external dimension in the vertical direction of a central part of the window glass. L41 is a length from a connection portion of a bus bar extraction portion 27*b* and the lower bus bar 27 to an obliquely downward bend part of the lower bus bar 27. L42 is a length from a connection portion of the bus bar extraction portion 26*b* and the upper bus bar 26 to an upper end of a right vertical edge side of the concave portion.

As illustrated in FIG. 19, for the respective bus bars, bus bar extraction portions 24*a*, 25*a*, 26*a*, 26*b*, 27*a* and 27*b* are arranged. The left upper bus bar 26 is connected to the vehicle body in a direct current manner because the bus bar extraction portion 26*a* is threadably mounted on the vehicle body. The right upper bus bar 26 is connected to the vehicle body in a direct current manner because the bus bar extraction portion 26*b* is threadably mounted on the vehicle body. The right bus bar 24 and the left bus bar 25 are set to not have bus bar extraction portions.

Figure 20:
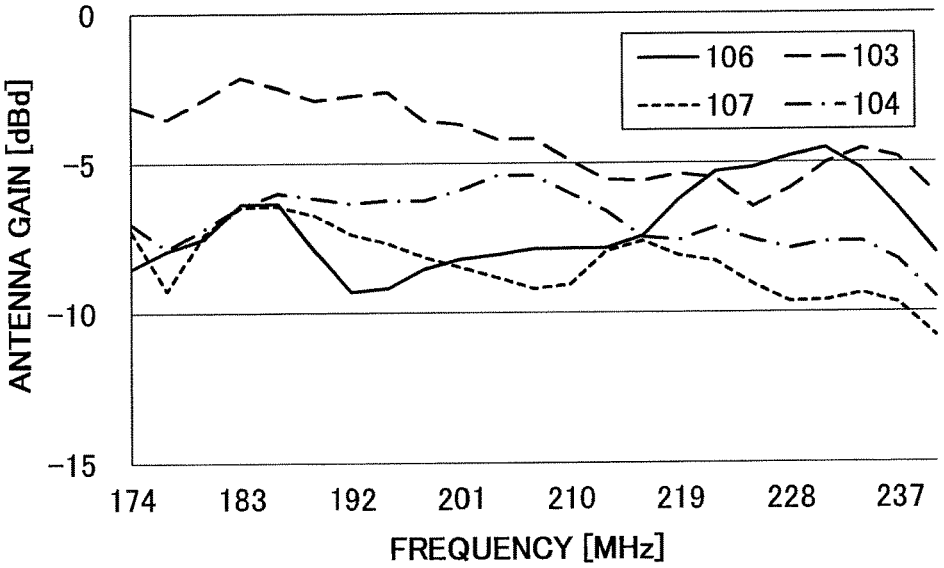
FIG. 20 is a diagram showing a result of measurement of antenna gain by form of an antenna.
Figure 21:
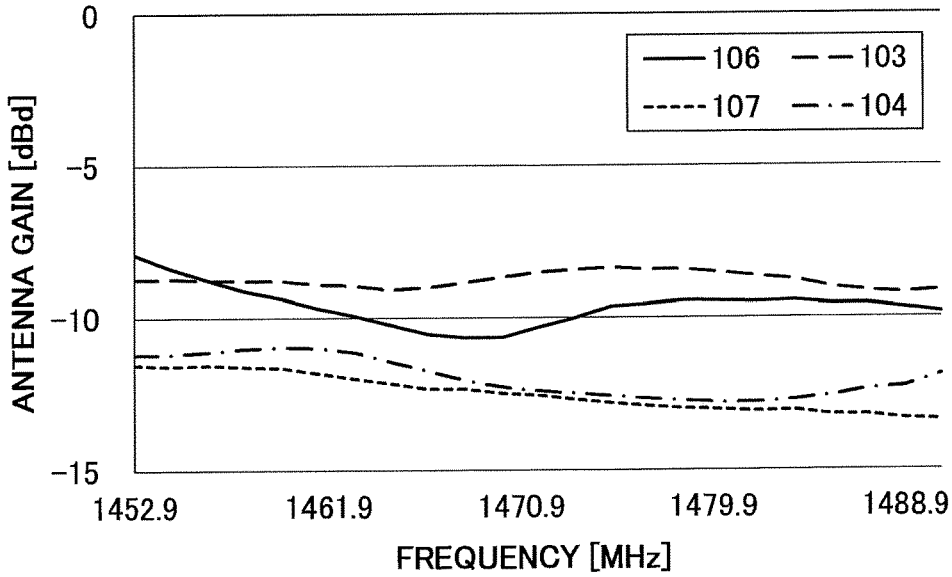
FIG. 21 is a diagram showing another result of measurement of antenna gain by form of the antenna.

As shown in FIG. 20, in any of the antennas, in band III, antenna gains of −11 dBd or more can be secured. As shown in FIG. 21, in any of the antennas, in L band, antenna gains of −13 dBd or more can be secured.

Practical Example 2

In the following, results of measurements of antenna gains for glass antennas of window glasses 106, 206 and 306 illustrated in FIGS. 22, 23 and 24 assembled into front window frames of actual vehicles respectively, will be described.

Figure 22:
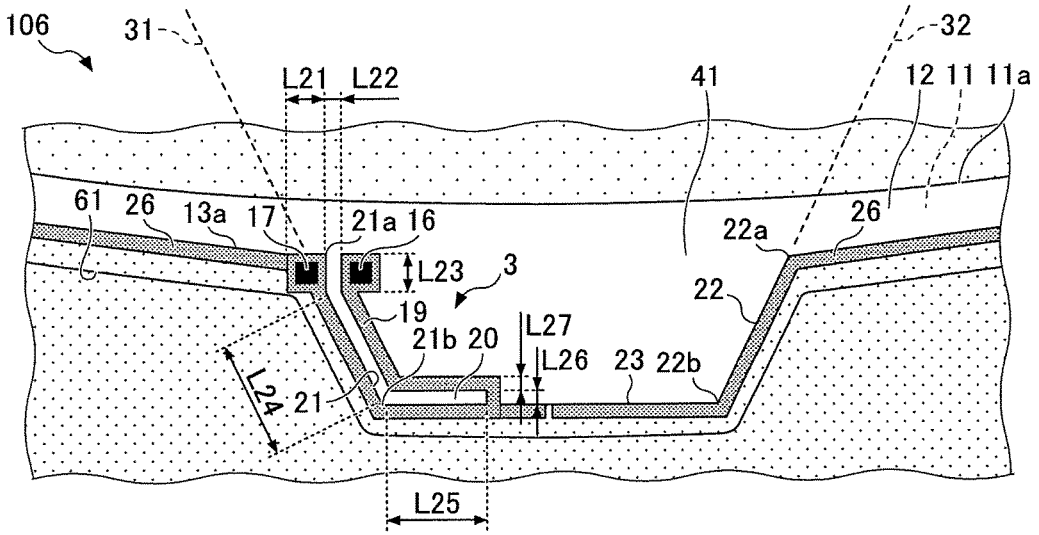
FIG. 22 is a plan view depicting an example of an antenna.

The window glass 106 and the antenna 3 illustrated in FIG. 22 have the same configuration as those illustrated in FIG. 6. In the planar view of the window glass 106 (in a view inside the vehicle), the first feeding portion 16 is arranged at a position closer to the upper end 21*a* of the first vertical edge side 21 than the horizontal edge side 23 of the concave portion 41. That is, in the planar view of the window glass 106, the shortest distance (referred to as "D1") between the first feeding portion 16 and the upper end 21*a* of the first vertical edge side 21 is less than the shortest distance (referred to as "D2") between the first feeding portion 16 and the horizontal edge side 23 of the concave portion 41.

Figure 23:
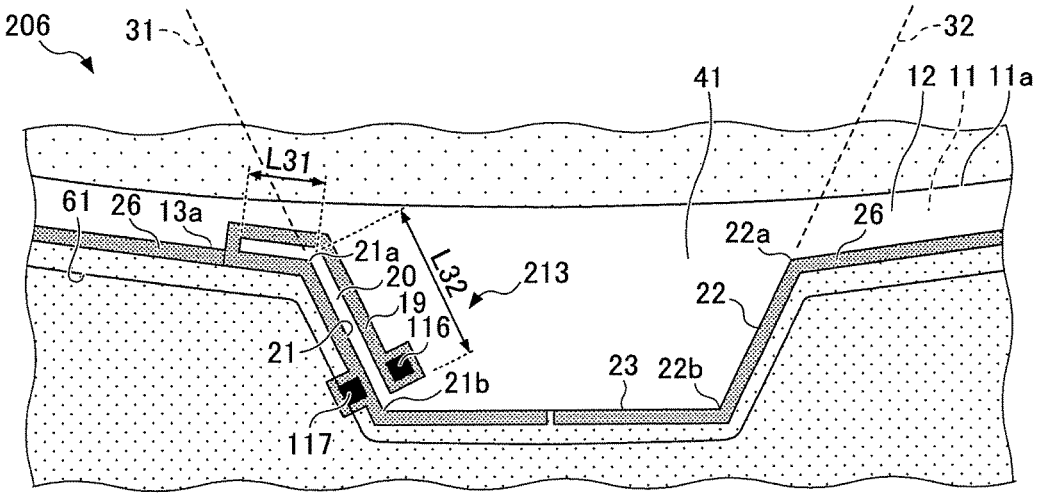
FIG. 23 is a plan view depicting another example of the antenna.

The window glass 206 and an antenna 213 illustrated in FIG. 23 are comparative examples to be compared with the window glass 106 and the antenna 3 illustrated in FIG. 22. In the planar view of the window glass 206, a first feeding portion 116 is arranged at a position farther from the upper end 21*a* of the first vertical edge side 21 than from the horizontal edge side 23 of the concave portion 41. That is, in the planar view of the window glass 206, the shortest distance (referred to as "D3") between the first feeding portion 116 and the upper end 21*a* of the first vertical edge side 21 is greater than the shortest distance (referred to as "D4") between the first feeding portion 116 and the horizontal edge side 23 of the concave portion 41.

Figure 24:
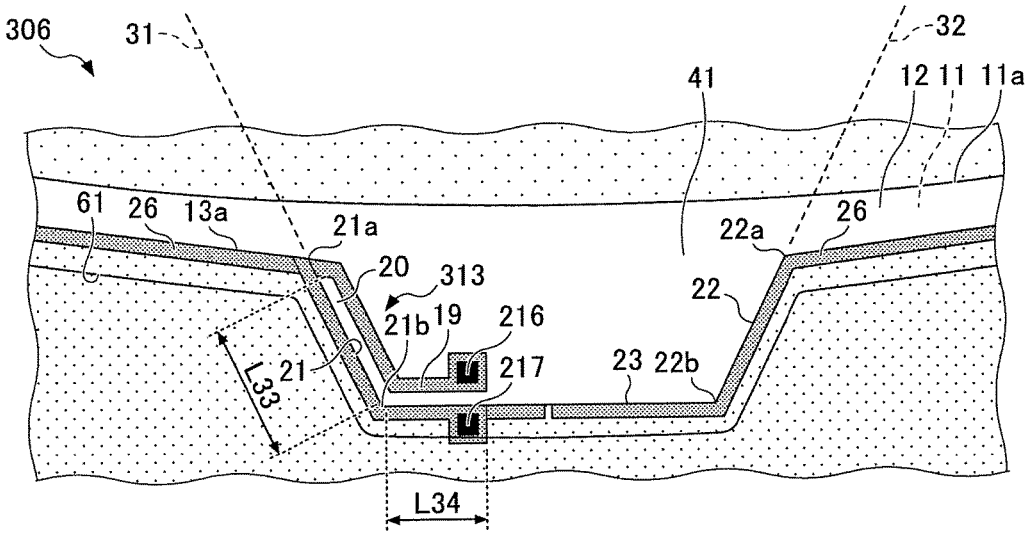
FIG. 24 is a plan view depicting yet another example of the antenna.

The window glass 306 and an antenna 313 illustrated in FIG. 24 are comparative examples to be compared with the window glass 106 and the antenna 3 illustrated in FIG. 22. In the planar view of the window glass 306, a first feeding portion 216 is arranged at a position farther from the upper end 21*a* of the first vertical edge side 21 than from the horizontal edge side 23 of the concave portion 41. That is, in the planar view of the window glass 306, the shortest distance (referred to as "D5") between the first feeding portion 216 and the upper end 21*a* of the first vertical edge side 21 is greater than the shortest distance (referred to as "D6") between the first feeding portion 216 and the horizontal edge side 23 of the concave portion 41.

Relationships are such that the shortest distance D1 is less than the shortest distance D3, and the shortest distance D3 is less than the shortest distance D5.

In the window glass 106 illustrated in FIG. 22, dimensions of the respective parts upon measuring antenna gain of the antenna 3 are (in units of mm)

L21: 25,
L22: 10,
L23: 24,
L24: 98,
L25: 70,
L26: 10, and
L27: 10.

In the window glass 206 illustrated in FIG. 23, dimensions of the respective parts upon measuring antenna gain of the antenna 213 are (in units of mm)

L31: 68, and
L32: 122.

In the window glass 306 illustrated in FIG. 24, dimensions of the respective parts upon measuring antenna gain of the antenna 313 are (in units of mm)

L33: 109, and
L34: 80.

In the measurement of antenna gains, for convenience of experiments, a window glass, on which a copper foil that simulated the conductive body 13, the antenna element 19, the first feeding portion and the second feeding portion, had been bonded, was used. For the window glass, a laminated glass, in which an intermediate film with a thickness of 30 mils was interposed between a pair of glass plates with a thickness of 2 mm, respectively, was used.

The copper foil that simulated the conductive body 13 and the antenna element 19, was bonded to a vehicle external side surface of the first glass plate 11 arranged outside the vehicle, so that the slot lengths of the respective antennas 3, 213 and 313 were 190±1 mm.

Figure 25:
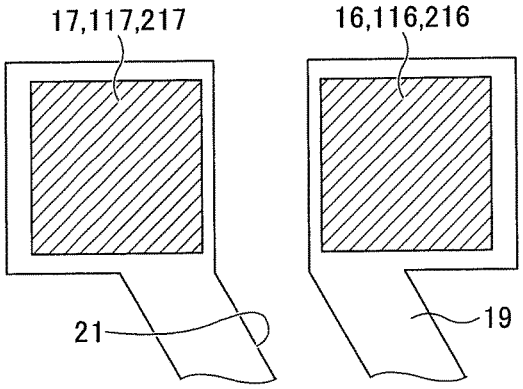
FIG. 25 is a plan view depicting an example of an outer shape of a first feeding portion and a second feeding portion.

The copper foil that simulated the first feeding portion and the second feeding portion (See FIG. 25) was bonded to a vehicle internal side surface of the second glass plate 12 arranged inside the vehicle. FIG. 25 is a plan view depicting an example of an outer shape of the first feeding portion and the second feeding portion. A copper foil simulating the first feeding portion 16, 116 or 216 and a copper foil simulating the second feeding portion 17, 117 or 217 are bonded to the vehicle internal side surface of the second glass plate 12 (shaded areas illustrated in FIG. 25).

Other conditions of measurement for antenna gain were the same as in the practical example 1.

Figure 26:
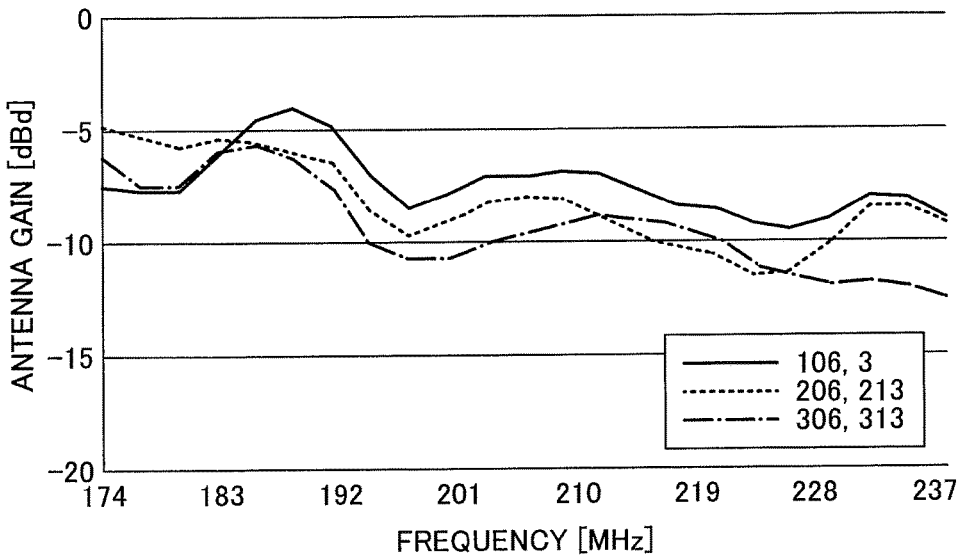
FIG. 26 is a diagram showing a result of measurement of antenna gain by form of an antenna.

FIG. 26 depicts an example of results of measurement for antenna gain within the range of 174 MHz to 240 MHz. Data denoted by "106,3" show results in the case of the window glass 106 and the antenna 3 illustrated in FIG. 22. Data denoted by "206,213" show results in the case of the window glass 206 and the antenna 213 illustrated in FIG. 23. Data denoted by "306,313" show results in the case of the window glass 306 and the antenna 313 illustrated in FIG. 24.

In the case of the window glass 106 and the antenna 3 illustrated in FIG. 22, a power average of antenna gain measured at each 3 MHz within the range of 174 MHz to 240 MHz was −7.2 dBd. In the case of the window glass 206 and the antenna 213 illustrated in FIG. 23, a power average of antenna gain measured at each 3 MHz within the range of 174 MHz to 240 MHz was −7.8 dBd. In the case of the window glass 306 and the antenna 313 illustrated in FIG. 24, a power average of antenna gain measured at each 3 MHz within the range of 174 MHz to 240 MHz was −8.9 dBd.

Therefore, in the case illustrated in FIG. 22 (practical example), in which the shortest distance between the first feeding portion and the upper end 21*a* of the first vertical edge side 21 is small, a greater antenna gain can be obtained than in the cases illustrated in FIGS. 23 and 24 (comparative examples), in which the shortest distances are great.

Practical Example 3

In the following, results of measurements of antenna gains for glass antennas of window glasses 103, 203, 303 and 102 illustrated in FIGS. 27 to 30 assembled into front, window frames of actual vehicles respectively, will be described.

Figure 27:
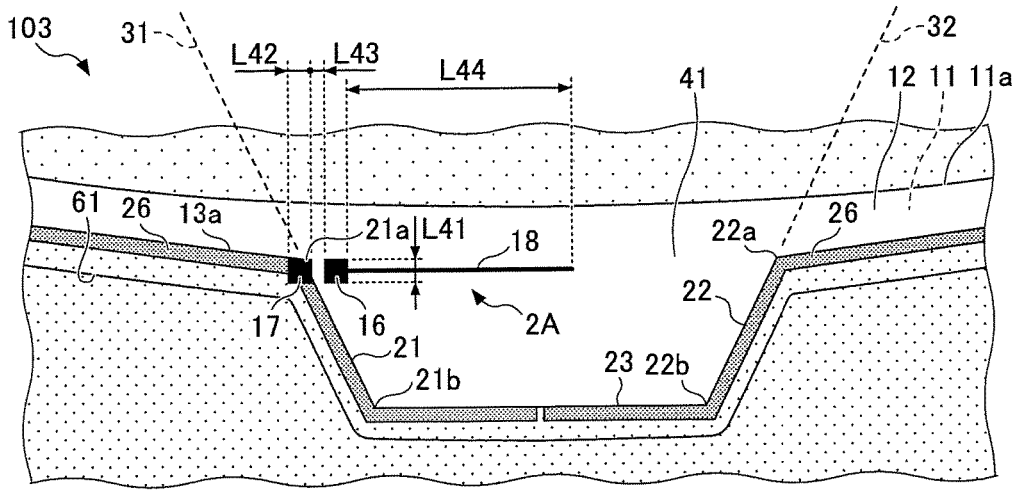
FIG. 27 is a plan view depicting an example of an antenna.
Figure 30:
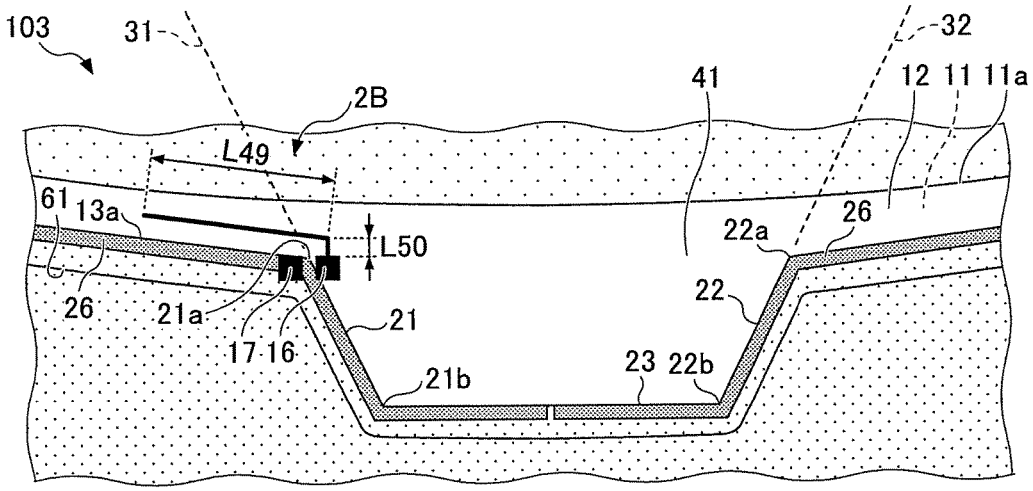
FIG. 30 is a plan view depicting still another example of the antenna.

The window glass 103 and the antenna 2A illustrated in FIG. 27 have the same configuration as those illustrated in FIG. 3. In the planar view of the window glass 103, the first feeding portion 16 is arranged at a position closer to the upper end 21*a* of the first vertical edge side 21 than the horizontal edge side 23 of the concave portion 41. That is, in the planar view of the window glass 103, the shortest distance (referred to as "D7") between the first feeding portion 16 and the upper end 21*a* of the first vertical edge side 21 is less than the shortest distance (referred to as "D8") between the first feeding portion 16 and the horizontal edge side 23 of the concave portion 41. The same applies to FIG. 30. In FIG. 30, although the window glass 103 has the same configuration as that illustrated in FIG. 3, the antenna 2B has a configuration of a variation of the antenna 2 illustrated in FIG. 3.

Figure 28:
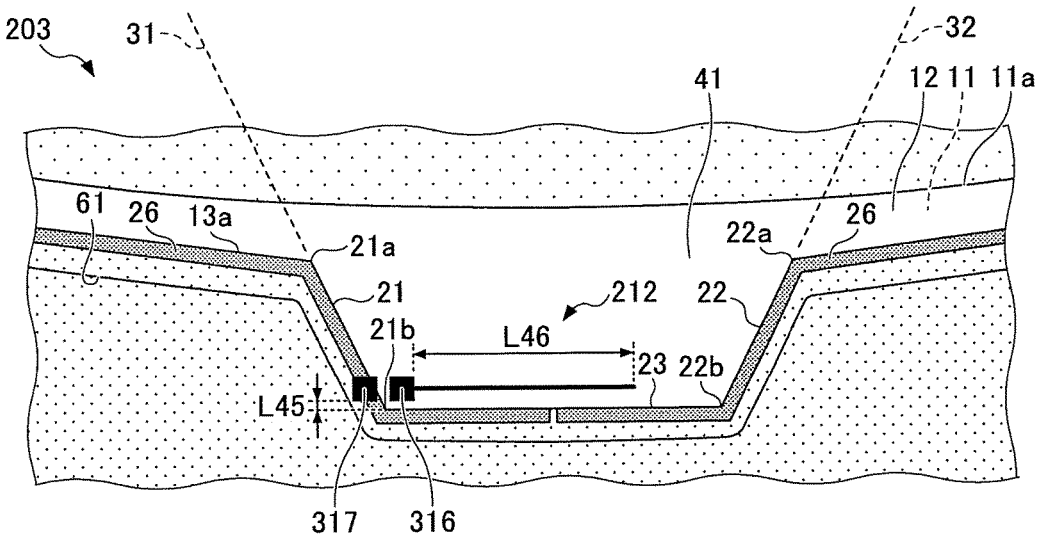
FIG. 28 is a plan view depicting another example of the antenna.

The window glass 203 and an antenna 212 illustrated in FIG. 28 are comparative examples to be compared with the window glass 103 and the antenna 2A illustrated in FIG. 27 and the window glass 103 and the antenna 2B illustrated in FIG. 30. In the planar view of the window glass 203, a first feeding portion 316 is arranged at a position farther from the upper end 21*a* of the first vertical edge side 21 than from the horizontal edge side 23 of the concave portion 41. That is, in the planar view of the window glass 203, the shortest distance (referred to as "D9") between the first feeding portion 316 and the upper end 21*a* of the first vertical edge side 21 is greater than the shortest distance (referred to as "D10") between the first feeding portion 316 and the horizontal edge side 23 of the concave portion 41.

Figure 29:
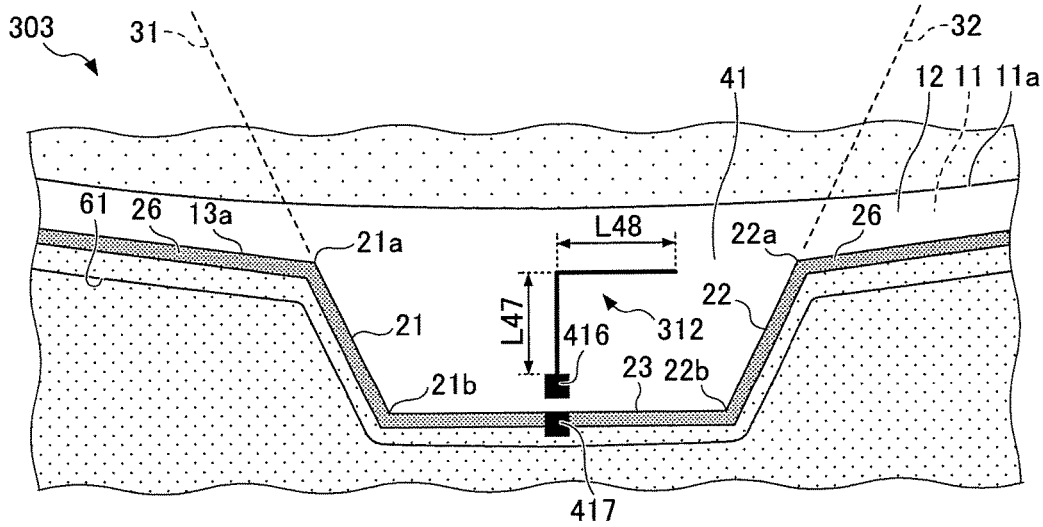
FIG. 29 is a plan view depicting yet another example of the antenna.

The window glass 303 and an antenna 312 illustrated in FIG. 29 are comparative examples to be compared with the window glass 106 and the antenna 3 illustrated in FIG. 22. In the planar view of the window glass 303, a first feeding portion 416 is arranged at a position farther from the upper end 21*a* of the first vertical edge side 21 than from the horizontal edge side 23 of the concave portion 41. That is, in the planar view of the window glass 303, the shortest distance (referred to as "D11") between the first feeding portion 416 and the upper end 21*a* of the first vertical edge side 21 is greater than the shortest distance (referred to as "D12") between the first feeding portion 416 and the horizontal edge side 23 of the concave portion 41.

Relations are such that the shortest distance D7 is less than the shortest distance D9, and the shortest distance D9 is less than the shortest distance D11.

In the window glass 103 illustrated in FIG. 27, dimensions of the respective parts upon measuring antenna gain of the antenna 2A are (in units of mm)

L41: 15,

L42: 15,

L43: 10, and

L44: 180.

In the window glass 203 illustrated in FIG. 28, dimensions of the respective parts upon measuring antenna gain of the antenna 212 are (in units of mm)

L45: 5, and

L46: 180.

In the window glass 303 illustrated in FIG. 29, dimensions of the respective parts upon measuring antenna gain of the antenna 312 are (in units of mm)

L47: 80, and

L48: 100.

In the window glass 103 illustrated in FIG. 30, dimensions of the respective parts upon measuring antenna gain of the antenna 2B are (in units of mm)

L49: 165, and

L50: 15.

Other conditions of measurement for antenna gain were the same as in the practical example 2.

Figure 31:
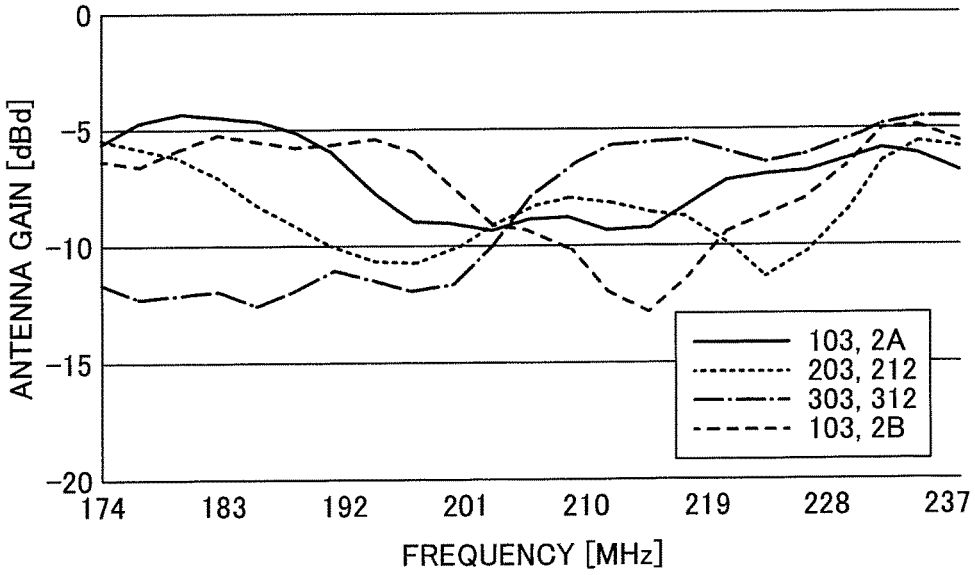
FIG. 31 is a diagram showing a result of measurement of antenna gain by form of an antenna.

FIG. 31 depicts an example of results of measurement for antenna gain within the range of 174 MHz to 240 MHz. Data denoted by "103,2A" show results in the case of the window glass 103 and the antenna 2A illustrated in FIG. 27. Data denoted by "203,212" show results in the case of the window glass 203 and the antenna 212 illustrated in FIG. 28. Data denoted by "303,312" show results in the case of the window glass 303 and the antenna 312 illustrated in FIG. 29. Data denoted by "103,2B" show results in the case of the window glass 103 and the antenna 2B illustrated in FIG. 30.

In the case of the window glass 103 and the antenna 2A illustrated in FIG. 27, a power average of antenna gain measured at each 3 MHz within the range of 174 MHz to 240 MHz was −6.7 dBd. In the case of the window glass 203 and the antenna 212 illustrated in FIG. 28, a power average of antenna gain measured at each 3 MHz within the range of 174 MHz to 240 MHz was −8.0 dBd. In the case of the window glass 303 and the antenna 312 illustrated in FIG. 29, a power average of antenna gain measured at each 3 MHz within the range of 174 MHz to 240 MHz was −7.6 dBd. In the case of the window glass 103 and the antenna 2B illustrated in FIG. 30, a power average of antenna gain measured at each 3 MHz within the range of 174 MHz to 240 MHz was −7.0 dBd.

Therefore, in the cases illustrated in FIGS. 27 and 30 (practical examples), in which the shortest distance between the first feeding portion and the upper end 21*a* of the first vertical edge side 21 is small, a greater antenna gain can be obtained than in the cases illustrated in FIGS. 28 and 29 (comparative examples), in which these shortest distances are great.

Practical Example 4

Figure 32:
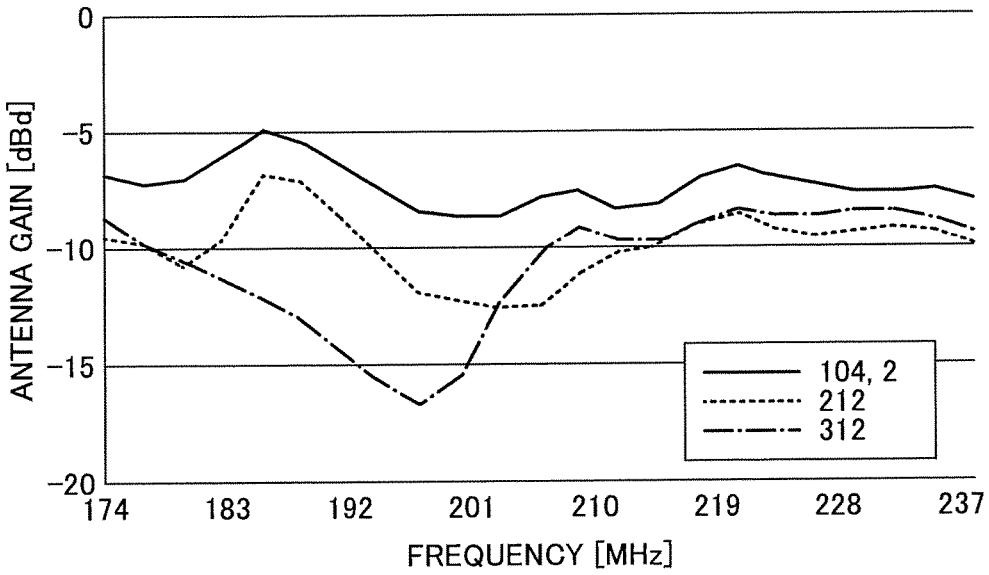
FIG. 32 is a diagram showing another result of measurement of antenna gain by form of the antenna.

FIG. 32 depicts an example of results of measurement for antenna gain within the range of 174 MHz to 240 MHz. Data denoted by "104,2" show results in the case (practical example) of the window glass 104 and the antenna 2 illustrated in FIG. 4. Data denoted by "212" show results in the case (comparative example) where, in the configuration illustrated in FIG. 4, the antenna 2 was only replaced by the antenna 212 illustrated in FIG. 28. Data denoted by "312" show results in the case (comparative example) where, in the configuration illustrated in FIG. 4, the antenna 2 was only replaced by the antenna 312 illustrated in FIG. 29.

In the case of the window glass 104 and the antenna 2 illustrated in FIG. 4 (practical example), a power average of antenna gain measured at each 3 MHz within the range of 174 MHz to 240 MHz was −7.1 dBd. In the case (comparative example) where, in the configuration illustrated in FIG. 4, the antenna 2 was only replaced by the antenna 212 illustrated in FIG. 28, a power average of antenna gain measured at each 3 MHz within the range of 174 MHz to 240 MHz was −9.6 dBd. In the case (comparative example) where, in the configuration illustrated in FIG. 4, the antenna 2 was only replaced by the antenna 312 illustrated in FIG. 29, a power average of antenna gain measured at each 3 MHz within the range of 174 MHz to 240 MHz was −10.2 dBd.

Therefore, even in the configuration in which the conductive line 52 illustrated in FIG. 4 is used, in the case (practical examples) where the shortest distance between the first feeding portion and the upper end 21*a* of the first vertical edge side 21 is small, a greater antenna gain can be obtained than in the case (comparative examples) where these shortest distances are great.

Practical Example 5

Figure 33:
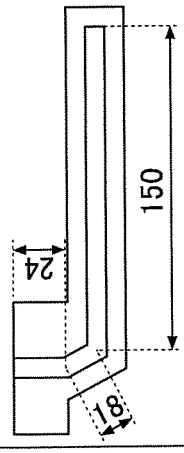
FIG. 33 is a diagram depicting an example of a result of measurement of antenna gain due to differences in an aspect ratio.
Figure 33:
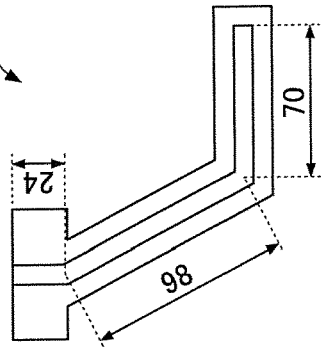
Figure 33:
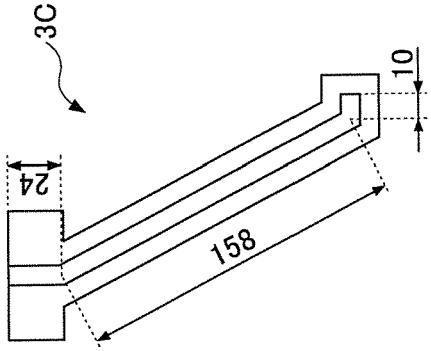

FIG. 33 depicts an example of results of measurement for antenna gain within the band III (174 MHz to 240 MHz) and the L band (1452 MHz to 1490 MHz). FIG. 33 is a diagram depicting an example of a variation in antenna gain of a slot antenna (slot antennas 3A, 3B and 3C) according to a difference in an aspect ratio of a slot of the slot antenna, under a condition that slot lengths of the slot antennas 3A, 3B and 3C are the same (192 mm in the present example).

The slot antennas 3A, 3B and 3C are examples of the slot antenna 3, respectively. The aspect ratio can be obtained by dividing the "length of the slot in the vertical direction" by the "length of the slot in the horizontal direction". For example, the aspect ratio 0.28 of the slot of the slot antenna 3A is obtained by (24+18)/150.

An antenna gain of the band III shown in FIG. 33 indicates a power average of antenna gain measured at each 3 MHz within the range of 174 MHz to 240 MHz. An antenna gain of the L band shown in FIG. 33 indicates a power average of antenna gain measured at each 6.8 MHz within the range of 1452 MHz to 1490 MHz.

Within the frequency band of the band III, even when the aspect ratio varies, the antenna gains of the respective slot antennas 3A, 3B and 3C are almost constant. Even when the window glass 106 and antenna 3 according to the embodiment vary in dimensions in manufacturing, and even when a shape of a region, in which the antenna can be arranged, is restricted, a desired antenna gain can be obtained. In the frequency band of the L band, by making the shape of the antenna vertically long, a great antenna gain can be obtained. That is, in the frequency band of the L band, the antenna gain of the slot antenna 3C is greater than the antenna gains of the slot antennas 3A and 3B.

REFERENCE SIGNS LIST

1, 2, 3 antenna
11 first glass plate
12 second glass plate
13 conductive body
13*a* upper outer edge
13*e* upper edge portion
13*f* lower edge portion
14 intermediate film
16 first feeding portion
17 second feeding portion
18 antenna element
19 antenna element
20 slot
21 first vertical edge side
21*a* upper end
22 second vertical edge side
23 horizontal edge side
24 right bus bar
25 left bus bar
26 upper bus bar
27 lower bus bar
31 first extension reference line
32 second extension reference line
33 dielectric substrate
38 bonding layer
41 concave portion
42 extension region
51 conductive film
52 conductive line
60 shielding film
61 shielding edge
101,102,103,104,105,106,107 window glass

What is claimed is:

1. A vehicle window glass, provided with a glass plate; a dielectric body; a conductive body arranged between the glass plate and the dielectric body; and an antenna, wherein the conductive body includes an upper edge portion in which a concave portion is provided, wherein the concave portion is a region interposed between a first vertical edge side and a second vertical edge side extending downward from an upper outer edge of the conductive body, wherein the antenna includes a feeding portion, and an antenna element electrically connected to the feeding portion, wherein, in a planar view of the vehicle window glass, at least a part of the feeding portion and at least a part of the antenna element are located in a region of at least one of a region interposed between a first extension reference line extended upward from the first vertical edge side and a second extension reference line extended upward from the second vertical edge side and of the concave portion, and wherein, in a planar view of the vehicle window glass, the feeding portion is arranged at a position closer to the first vertical edge side than a lower end of the concave portion.

2. The vehicle window glass according to claim 1, wherein, in a planar view of the vehicle window glass, the feeding portion is arranged at a position closer to an upper end of the first vertical edge side than the lower end of the concave portion.

3. The vehicle window glass according to claim 2, wherein the feeding portion faces the antenna element via the dielectric body.

4. The vehicle window glass according to claim 2, wherein the conductive body includes an upper band-like electrode arranged on the upper edge portion of the conductive body; a lower band-like electrode arranged on a lower edge portion of the conductive body; a conductive film or a conductive line conductively connected to the upper band-like electrode and the lower band-like electrode, wherein the upper band-like electrode includes the first vertical edge side and the second vertical edge side.

5. The vehicle window glass according claim 2 comprising a shielding film that shields at least a part of the antenna as well as at least a part of the concave portion, wherein the shielding film is arranged between at least a part of the antenna as well as at least a part of the concave portion and the glass plate.

6. The vehicle window glass according to claim 1, wherein the feeding portion faces the antenna element via the dielectric body.

7. The vehicle window glass according to claim 6, wherein the conductive body includes an upper band-like electrode arranged on the upper edge portion of the conductive body; a lower band-like electrode arranged on a lower edge portion of the conductive body; a conductive film or a conductive line conductively connected to the upper band-like electrode and the lower band-like electrode, wherein the upper band-like electrode includes the first vertical edge side and the second vertical edge side.

8. The vehicle window glass according claim 6 comprising a shielding film that shields at least a part of the antenna as well as at least a part of the concave portion, wherein the shielding film is arranged between at least a part of the antenna as well as at least a part of the concave portion and the glass plate.

9. The vehicle window glass according to claim 1, wherein the feeding portion includes a first feeding portion electrically connected to the antenna element; and a second feeding portion electrically connected to the upper edge portion of the conductive body, wherein, in a planar view of the vehicle window glass, the first feeding portion is arranged at a position closer to the first vertical edge side than the lower end of the concave portion.

10. The vehicle window glass according to claim 9, wherein the second feeding portion faces the upper edge portion of the conductive body via the dielectric body.

11. The vehicle window glass according to claim 10, wherein the first feeding portion faces the antenna element via the dielectric body.

12. The vehicle window glass according to claim 10, wherein the antenna is a slot antenna including a slot fainted between the antenna element and the first vertical edge side.

13. The vehicle window glass according to claim 11, wherein the antenna is a slot antenna including a slot formed between the antenna element and the first vertical edge side.

14. The vehicle window glass according to claim 9, wherein the first feeding portion faces the antenna element via the dielectric body.

15. The vehicle window glass according to claim 14, wherein the antenna is a slot antenna including a slot formed between the antenna element and the first vertical edge side.

16. The vehicle window glass according to claim 9, wherein the antenna is a slot antenna including a slot forming between the antenna element and the first vertical edge side.

17. The vehicle window glass according to claim 9, wherein the conductive body includes an upper band-like electrode arranged on the upper edge portion of the conductive body; a lower band-like electrode arranged on a lower edge portion of the conductive body; a conductive film or a conductive line conductively connected to the upper band-like electrode and the lower band-like electrode, wherein the upper band-like electrode includes the first vertical edge side and the second vertical edge side.

18. The vehicle window glass according to claim 1, wherein the conductive body includes an upper band-like electrode arranged on the upper edge portion of the conductive body; a lower band-like electrode arranged on a lower edge portion of the conductive body; a conductive film or a conductive line conductively connected to the upper band-like electrode and the lower band-like electrode, wherein the upper band-like electrode includes the first vertical edge side and the second vertical edge side.

19. The vehicle window glass according claim 1 comprising a shielding film that shields at least a part of the antenna as well as at least a part of the concave portion, wherein the shielding film is arranged between at least a part of the antenna as well as at least a part of the concave portion and the glass plate.

20. An antenna arranged on a vehicle window glass, provided with a feeding portion; and an antenna element electrically connected to the feeding portion, wherein the vehicle window glass includes a conductive body having an upper edge portion in which a concave portion is arranged, wherein the concave portion is a region interposed between a first vertical edge side and a second vertical edge side extending downward from an upper outer edge of the conductive body, wherein, in a planar view of the vehicle window glass, at least a part of the feeding portion and at least a part of the antenna element are located in a region of at least one of a region interposed between a first extension reference line extended upward from the first vertical edge side and a second extension reference line extended upward from the second vertical edge side and of the concave portion, and wherein, in a planar view of the vehicle window glass, the feeding portion is arranged at a position closer to the first vertical edge side than a lower end of the concave portion.

* * * * *